US008128212B2

(12) United States Patent
Katada et al.

(10) Patent No.: US 8,128,212 B2
(45) Date of Patent: Mar. 6, 2012

(54) INKJET RECORDING APPARATUS AND RECORDING METHOD

(75) Inventors: Masahito Katada, Kanagawa-ken (JP); Atsushi Murakami, Ebina (JP)

(73) Assignees: Fujifilm Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 657 days.

(21) Appl. No.: 12/252,612

(22) Filed: Oct. 16, 2008

(65) Prior Publication Data

US 2009/0102879 A1 Apr. 23, 2009

(30) Foreign Application Priority Data

Oct. 19, 2007 (JP) ..... 2007-272681

(51) Int. Cl.
*B41J 2/18* (2006.01)

(52) U.S. Cl. ..... 347/89

(58) Field of Classification Search ..... None
See application file for complete search history.

(56) References Cited

U.S. PATENT DOCUMENTS

| | | | | |
|---|---|---|---|---|
| 5,910,810 | A | 6/1999 | Brooks et al. | |
| 7,097,287 | B2 | 8/2006 | Nakao et al. | |
| 7,896,966 | B2 | 3/2011 | Masuyama et al. | |
| 2002/0001024 | A1 * | 1/2002 | Wouters et al. | 347/89 |
| 2003/0122905 | A1 | 7/2003 | Suzuki et al. | |
| 2005/0219282 | A1 | 10/2005 | Kachi | |
| 2007/0091150 | A1 | 4/2007 | Kodama | |
| 2007/0115311 | A1 | 5/2007 | Takatsuka | |
| 2007/0126816 | A1 * | 6/2007 | Nishida | 347/85 |
| 2007/0252860 | A1 | 11/2007 | Nitta et al. | |

FOREIGN PATENT DOCUMENTS

| | | | |
|---|---|---|---|
| EP | 0 916 502 | A3 | 5/1999 |
| JP | 04-053754 | * | 2/1992 |
| JP | 10-114081 | A | 5/1998 |
| JP | 2000-280493 | A | 10/2000 |
| JP | 2005-280246 | A | 10/2005 |
| JP | 2007-130907 | A | 5/2007 |
| WO | WO 2006064040 | A1 * | 6/2006 |

* cited by examiner

*Primary Examiner* — Matthew Luu
*Assistant Examiner* — Erica Lin
(74) *Attorney, Agent, or Firm* — Birch, Stewart, Kolasch & Birch, LLP

(57) ABSTRACT

An inkjet recording apparatus has: a pressure control device which controls a liquid movement device in accordance with determination results of a first pressure determination device and a second pressure determination device in such a manner that interiors of a first liquid chamber and a second liquid chamber respectively assume prescribed pressures, wherein the pressure control device controls the liquid movement device so as to adjust the internal pressures of the first liquid chamber and the second liquid chamber in such a manner that a prescribed pressure differential between the internal pressures of the first liquid chamber and the second liquid chamber is produced and a prescribed back pressure is applied to the liquid inside a plurality of nozzles of a recording head.

9 Claims, 13 Drawing Sheets

INKJET RECORDING APPARATUS AND RECORDING METHOD

BACKGROUND OF THE INVENTION

1. Field of the Invention

The present invention relates to an inkjet recording apparatus and a recording method, and more particularly, to an inkjet recording apparatus and an inkjet recording method whereby continuous circulation of liquid can be achieved while maintaining the back pressure in a recording head of an inkjet type.

2. Description of the Related Art

The inkjet recording apparatus comprises a recording head of an inkjet type (an inkjet head, hereinafter simply called "head") which has a plurality of nozzles, and records an image by ejecting ink droplets respectively from the nozzles. Such apparatuses are used widely from commercial to industrial applications, due to their low operating noise, low running costs, and their capacity to record high quality images onto recording media of many various types. The ink ejection method used in the recording head may be a piezoelectric method in which ink droplets are ejected from nozzles by utilizing the displacement of piezoelectric elements to pressurize the ink inside pressure chambers, or a thermal method in which ink droplets are ejected from nozzles due to the pressure created by the growth of gas bubbles which are generated inside pressure chambers by means of the thermal energy created by heating elements, such as heaters, or the like.

In an inkjet recording apparatus, it is common to use a method which supplies ink to the recording head from a main tank and via sub tanks. According to a sub tank supply method of this kind, it is possible to suppress the internal pressure variation of the recording head, and it is also possible to improve the ejection stability of the recording head.

On the other hand, if air bubbles enter into the recording head or the ink inside the recording head (and in particular, in the vicinity of the nozzles) increases in viscosity, then there is a possibility that these factors can give rise to deterioration of the image quality, since fluctuation occurs in the droplet amount (volume) and ejection direction (direction of flight) of the ink droplets which are ejected from the respective nozzles, and nozzles suffering ejection failure occur due to blockages, and so on. In order to resolve problems of this kind, various technologies which circulate the ink inside the recording head have been proposed (see, for example, Japanese Patent Application Publication No. 2000-280493 and Japanese Patent Application Publication No. 10-114081).

Japanese Patent Application Publication No. 2000-280493 discloses technology of a system comprising a reserve tank which is provided in a unified fashion with the recording head and two sub tanks (a supply sub tank and an expulsion sub tank) which are connected to the reserve tank, and the ink in the supply sub tank is circulated to the expulsion sub tank via the reserve tank by reducing the pressure of the expulsion sub tank by means of a pump.

Japanese Patent Application Publication No. 10-114081 discloses technology of a system in which a sub tank is connected to one ink inlet port of two ink inlet ports which are provided in a recording head, and an ink cartridge is connected to the other ink inlet port, an outward and return ink circulation being created between the sub tank and the ink cartridge via the recording head. More specifically, by pressurizing an ink bag (ink supply source) provided inside the ink cartridge (sealed space) by means of an air pump, the ink inside the ink bag flows into the sub tank via the recording head, and when the sub tank has filled with ink, the air pump is halted and the ink inside the sub tank flows in reverse to the ink cartridge via the recording head due to the liquid head differential caused by the height differential between the recording head and the ink cartridge. If the volume inside the sub tank becomes smaller, then the air pump is operated and ink is replenished to the sub tank from the ink cartridge via the recording head. Thereupon, the ink replenishment operation described above is carried out each time the ink of the sub tank flows in reverse and reduces in volume. By means of an outward and return ink circulation of this kind, air bubbles present inside the recording head are eliminated and increase in the viscosity of the ink can be prevented.

However, there are problems of the following kinds associated with the related art ink circulation technology which is described above.

In the invention described in Japanese Patent Application Publication No. 2000-280493, by sealing and reducing the pressure of the expulsion sub tank of two sub tanks (a supply sub tank and the expulsion sub tank) which are connected to a reserve tank that is provided in a unified fashion with the recording head, a circulation operation is carried out which simply moves the ink forcibly from the supply sub tank to the expulsion sub tank via the reserve tank, the volume of ink which can be circulated in this way being dependent on the remaining amount of ink in the sub tank, and it is not possible to circulate ink continuously during printing, and the like. Furthermore, since the ink supply system uses the liquid head differential, then it is necessary to dispose the two sub tanks below the recording head, and therefore the flow channels between the recording head and the sub tanks become long and there is a large variation in the back pressure variation as a result of pressure loss. Consequently, there is a problem in that the ejected droplet volume varies and the print quality declines thereby.

The invention described in Japanese Patent Application Publication No. 10-114081 simply moves the ink in the outward and return directions via the recording head between one tank (an ink cartridge) and another tank (sub tank), and it is not able to circulate the ink continuously in one direction at all times (for example, the direction from the ink cartridge to the sub tank). Consequently, when the direction of movement of the ink (direction of ink circulation) is switched in accordance with the remaining amount of ink in the sub tank, then the back pressure of the recording head is liable to vary due to the pressure change which occurs during switching. Furthermore, since the sub tank uses a hydrostatic pressure system, then in the case of a recording head where the direction of ejection lies in the horizontal direction, it is possible to dispose the sub tank in the vicinity of the recording head and vertically below the recording head, but when applied to a recording head in which the direction of ejection is vertically downwards, then due to the position of the sub tank, the flow channel between the sub tank and the recording head becomes long and the loss of pressure becomes large. Consequently, there is a problem in that the ejected droplet volume varies and the print quality declines.

SUMMARY OF THE INVENTION

The present invention has been contrived in view of the foregoing circumstances, an object thereof being to provide an inkjet recording apparatus and a recording method whereby high-quality image recording can be carried out by achieving a continuous circulation of ink while maintaining the back pressure of a recording head.

In order to attain an object described above, one aspect of the present invention is directed to an inkjet recording apparatus, comprising: a recording head of an inkjet type having a liquid ejection surface where a plurality of nozzles which eject liquid are arranged, a supply port which supplies the liquid to an internal flow channel connected to the plurality of nozzles, and an outlet port which is connected to the supply port via the internal flow channel and through which the liquid in the internal flow channel is expelled; a first liquid chamber which is connected to the supply port of the recording head via a first external flow channel; a second liquid chamber which is connected to the outlet port of the recording head via a second external flow channel; a liquid buffer chamber which stores the liquid supplied from a liquid supply source; a first connecting flow channel which connects the first liquid chamber to the liquid buffer chamber; a second connecting flow channel which connects the second liquid chamber to the liquid buffer chamber; a first pressure determination device which determines an internal pressure of the first liquid chamber; a second pressure determination device which determines an internal pressure of the second liquid chamber; a liquid movement device which moves the liquid between the first liquid chamber, the second liquid chamber and the liquid buffer chamber; and a pressure control device which controls the liquid movement device in accordance with determination results of the first pressure determination device and the second pressure determination device in such a manner that interiors of the first liquid chamber and the second liquid chamber respectively assume prescribed pressures, wherein the pressure control device controls the liquid movement device so as to adjust the internal pressures of the first liquid chamber and the second liquid chamber in such a manner that a prescribed pressure differential between the internal pressures of the first liquid chamber and the second liquid chamber is produced and a prescribed back pressure is applied to the liquid inside the plurality of nozzles of the recording head.

According to this aspect of the invention, a pair of liquid chambers (a first liquid chamber and a second liquid chamber) and a liquid buffer chamber are provided and by moving liquid between these liquid chambers and the liquid buffer chamber, it is possible to maintain the interiors of the first liquid chamber and the second liquid chamber at prescribed pressures, and furthermore since a prescribed pressure differential is set between the first liquid chamber and the second liquid chamber and control is implemented in such a manner that a prescribed back pressure is applied to the liquid inside the nozzles of the recording head, then it is possible to achieve continuous circulation of liquid while maintaining the back pressure (negative pressure) of the recording head. By this means, the ejection reliability of the recording head is improved and stable and satisfactory print quality can be obtained.

In this aspect of the invention, preferably, the internal flow channel provided in the recording head passes in the vicinity of the nozzles, since increase in the viscosity of the liquid in the vicinity of the nozzles is prevented by the circulation of the liquid, stable ejection can be achieved.

Desirably, the inkjet recording apparatus comprises a first sub tank having the first liquid chamber and a first gas chamber that are separated by a first flexible film, and a second sub tank having the second liquid chamber and a second gas chamber that are separated by a second flexible film.

According to this aspect of the invention, it is possible to attenuate pressure variation caused by movement of liquid, by means of the flexible film and the gas chamber, and hence this pressure variation is not transmitted to the recording head and therefore good print quality can be ensured. Furthermore, highly accurate pressure adjustment can be achieved.

Desirably, the first liquid chamber and the second liquid chamber are disposed vertically above the recording head.

According to this aspect of the invention, since the flow channel (first external flow channel and second external flow channel) which connects the respective liquid chambers and the recording head can be made short in length, then it is possible to reduce pressure variations caused by loss of pressure in the flow channels, the accuracy of the pressure difference applied between the supply port and the outlet port of the recording head is improved, and a circulation of liquid can be achieved at low speed in the vicinity of the nozzles.

Desirably, the inkjet recording apparatus as defined in claim 1, further comprising a filter provided in the first connecting flow channel, wherein one end of the second connecting flow channel is connected to the second liquid chamber and another end of the second connecting flow channel is branched into a first branch flow channel and a second branch flow channel; the first branch flow channel is connected to the first connecting flow channel on a side closer to the liquid buffer chamber than the filter; the second branch flow channel is connected to the first connecting flow channel on a side closer to the first liquid chamber than the filter; a first check valve which permits a flow of the liquid only in a direction from the second liquid chamber toward the first connecting flow channel is provided in the first branch flow channel; and a second check valve which permits a flow of the liquid only in a direction from the first connecting flow channel toward the second liquid chamber is provided in the second branch flow channel.

According to this aspect of the invention, the liquid inside the liquid buffer chamber and the ink which has been circulated from the first liquid chamber to the second liquid chamber via the recording head is supplied again to the first liquid chamber and the second liquid chamber after passing through a filter, and therefore liquid of good quality which does not include foreign matter is circulated to the recording head and the ejection reliability of the recording head is improved.

Desirably, the inkjet recording apparatus further comprises a deaerator provided in the first connecting flow channel at a position between a part of the first connecting flow channel to which the first branch flow channel is connected and a part of the first connecting flow channel to which the second branch flow channel is connected.

According to this aspect of the invention, it is possible to circulate liquid having a good level of deaeration, and hence the ejection reliability of the recording head is further enhanced.

Desirably, the deaerator is disposed on a side closer to the first liquid chamber than the filter.

According to this aspect of the invention, increase in pressure loss caused by blockages in the deaerator is prevented and a long life span of the deaerator can be achieved.

Desirably, the liquid movement device includes: a first pump which is provided in the first connecting flow channel; and a second pump which is provided in the second connecting flow channel.

Desirably, the inkjet recording apparatus further comprises: a first bypass flow channel which connects a liquid input port and a liquid output port of the first pump; a second bypass flow channel which connects a liquid input port and a liquid output port of the second pump; a first bypass flow channel opening and closing valve which opens and closes the first bypass flow channel; and a second bypass flow channel opening and closing valve which opens and closes the second bypass flow channel, wherein: the first pump and the second pump are constituted respectively by pumps which are constantly free of leaks; the first bypass flow channel opening and closing valve is constituted by a normally open valve which opens the first bypass flow channel when power supply is switched off, and the second bypass flow channel opening and closing valve is constituted by a normally open valve which opens the second bypass flow channel when power supply is switched off; and the liquid buffer chamber is disposed in such a manner that a surface of the liquid stored in the liquid buffer chamber is disposed vertically below the liquid ejection surface of the recording head.

According to this aspect of the invention, when the power supply of the apparatus is switched off, a prescribed negative pressure is applied to the liquid inside the nozzles of the recording head due to the water head differential caused by the height differential between the liquid surface in the liquid buffer chamber and the liquid ejection surface (nozzle surface) of the recording head, and therefore the meniscus is maintained in position. By this means, infiltration of gas bubbles or leaking of liquid at the nozzles is prevented, and hence the frequency of head maintenance upon restarting of operation is reduced, running costs can be lowered and the start-up time of the apparatus can be shortened.

Desirably, the inkjet recording apparatus further comprises: a first expulsion flow channel via which a vertical upper portion of the first liquid chamber is connected to the second liquid chamber; and a second expulsion flow channel via which a vertical upper portion of the second liquid chamber is connected to the liquid buffer chamber.

According to this aspect of the invention, it is possible to expel the gas which is present in the first and second liquid chambers and the upstream side of same (the side of the liquid buffer chamber) to the exterior of the apparatus from the liquid buffer chamber, by using the first and second expulsion flow channels. In other words, it is possible to expel gas without passing via the recording head or the first and second external flow channels, the gas expulsion properties are improved and the initial loading of liquid can be facilitated, and furthermore, the liquid which moves to the liquid buffer chamber together with the gas can be circulated again and hence the effective usage rate of the liquid is improved.

In order to attain an object described above, another aspect of the present invention is directed to a recording method of an inkjet recording apparatus comprising: a recording head of an inkjet type having a plurality of nozzles which eject liquid, a supply port which supplies the liquid to an internal flow channel connected to the plurality of nozzles, and an outlet port which is connected to the supply port via the internal flow channel and through which the liquid in the internal flow channel is expelled; a first liquid chamber which is connected to the supply port of the recording head via a first external flow channel; a second liquid chamber which is connected to the outlet port of the recording head via a second external flow channel; a liquid buffer chamber which stores the liquid supplied from a liquid supply source; a first connecting flow channel which connects the first liquid chamber to the liquid buffer chamber; a second connecting flow channel which connects the second liquid chamber to the liquid buffer chamber; a first pressure determination device which determines an internal pressure of the first liquid chamber; a second pressure determination device which determines an internal pressure of the second liquid chamber; and a liquid movement device which moves the liquid between the first liquid chamber, the second liquid chamber and the liquid buffer chamber, wherein the liquid movement device is controlled according to determination results of the first pressure determination device and the second pressure determination device in such a manner that interiors of the first liquid chamber and the second liquid chamber respectively assume prescribed pressures, and the liquid movement device is controlled so as to adjust the internal pressures of the first liquid chamber and the second liquid chamber in such a manner that a prescribed pressure differential is set between the internal pressures of the first liquid chamber and the second liquid chamber and a prescribed back pressure is applied to the liquid inside the plurality of nozzles of the recording head.

According to the present invention, a pair of liquid chambers (a first liquid chamber and a second liquid chamber) and a liquid buffer chamber are provided and by moving liquid between these liquid chambers and the liquid buffer chamber, it is possible to maintain the interiors of the first liquid chamber and the second liquid chamber at prescribed pressures, and furthermore since a prescribed pressure differential is set between the first liquid chamber and the second liquid chamber and control is implemented in such a manner that a prescribed back pressure is applied to the liquid inside the nozzles of the recording head, then it is possible to achieve continuous circulation of liquid while maintaining the back pressure (negative pressure) of the recording head. By this means, the ejection reliability of the recording head is improved and stable and satisfactory print quality can be obtained.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
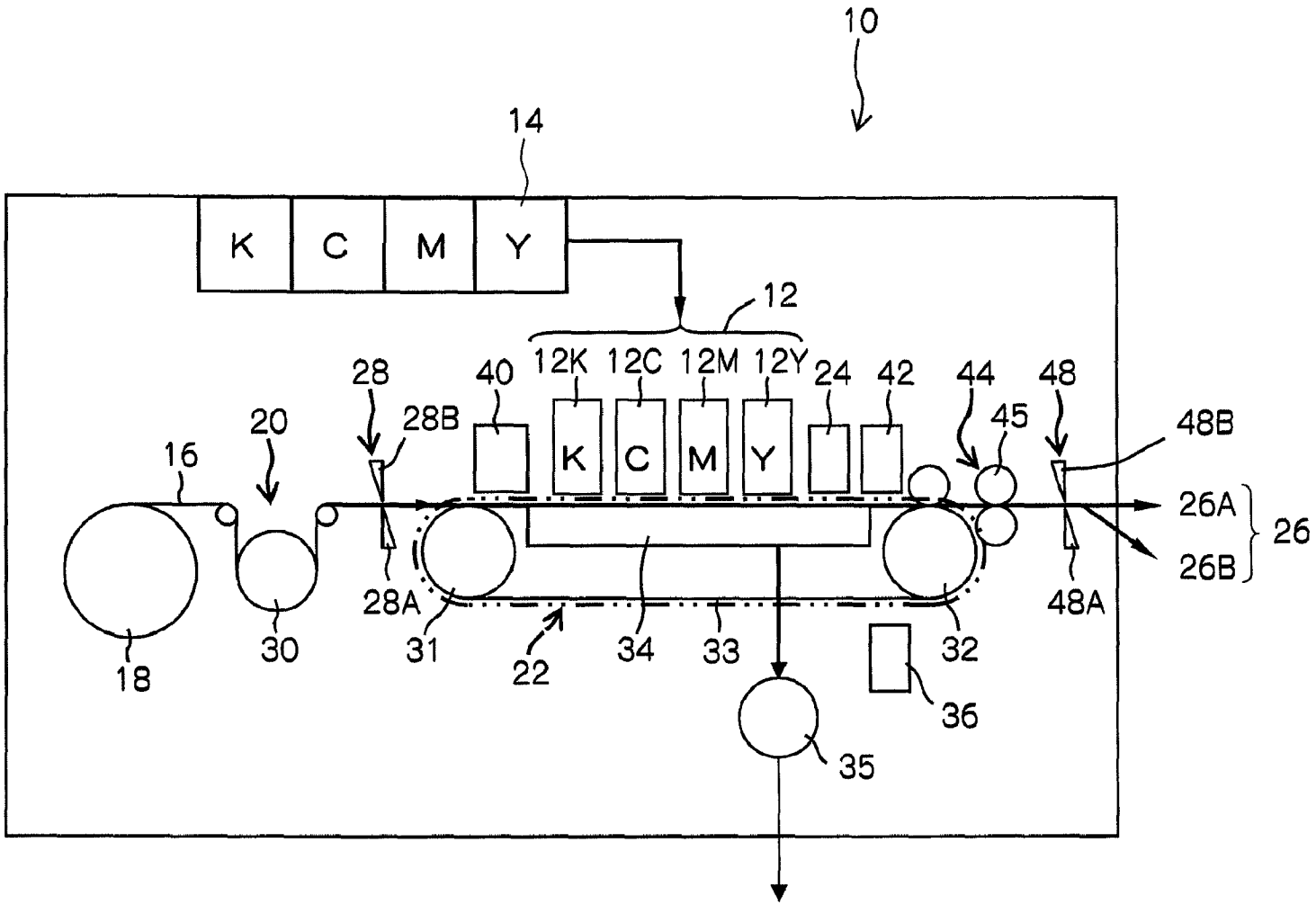
FIG. 1 is a general schematic drawing showing a general view of an inkjet recording apparatus.

FIG. 1 is a general configuration diagram of one embodiment of an inkjet recording apparatus according to an embodiment of the present invention. As illustrated in FIG. 1, the inkjet recording apparatus 10 comprises: a printing unit 12 having a plurality of recording heads (hereafter, also simply called "heads") 12K, 12C, 12M, and 12Y provided for the respective ink colors; an ink storing and loading unit 14 for storing inks of K, C, M and Y to be supplied to the printing heads 12K, 12C, 12M, and 12Y; a paper supply unit 18 for supplying recording paper 16; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as illustrated in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as illustrated in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effect.

A roller nip conveyance mechanism, in place of the suction belt conveyance unit 22, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
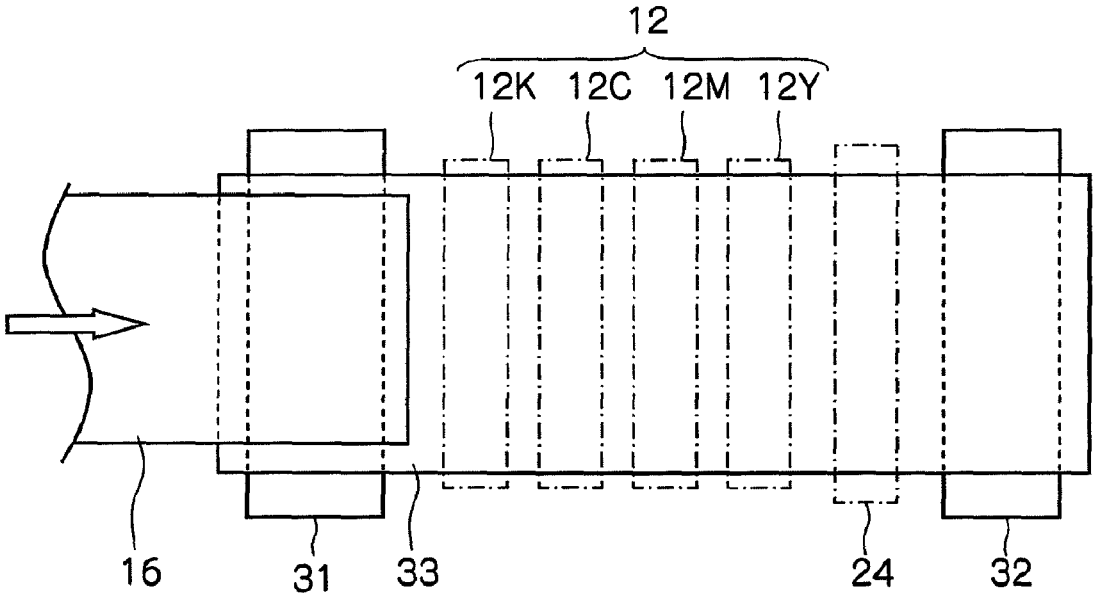
FIG. 2 is a principal plan diagram showing the peripheral area of a printing unit of the inkjet recording apparatus.

The printing unit 12 is a so-called "fill line head" in which a line head having a length corresponding to the maximum paper width is arranged in a direction (main scanning direction) that is perpendicular to the paper conveyance direction (sub scanning direction). Each of the printing heads 12K, 12C, 12M, and 12Y constituting the printing unit 12 is constituted by a line head, in which a plurality of ink ejection ports (nozzles) are arranged along a length that exceeds at least one side of the maximum-size recording paper 16 intended for use in the inkjet recording apparatus 10 (see FIG. 2).

The printing heads 12K, 12C, 12M, and 12Y are arranged in the order of black (K), cyan (C), magenta (M), and yellow (Y) from the upstream side, along the feed direction of the recording paper 16 hereinafter, referred to as the sub-scanning direction). A color image can be formed on the recording paper 16 by ejecting the inks from the printing heads 12K, 12C, 12M, and 12Y, respectively, onto the recording paper 16 while conveying the recording paper 16.

By adopting the printing unit 12 in which the full line heads covering the full paper width are provided for the respective ink colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action Higher-speed printing is thereby made possible and productivity can be improved in comparison with a shuttle type head configuration in which a head reciprocates in a direction (the main scanning direction) orthogonal to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added. Furthermore, there are no particular restrictions of the sequence in which the heads of respective colors are arranged.

As illustrated in FIG. 1, the ink storing and loading unit 14 has tanks for storing the inks of K, C, M and Y to be supplied to the heads 12K, 12C, 12M, and 12Y, and the tanks are connected to the heads 12K, 12C, 12M, and 12Y by means of channels, which are omitted from figures. The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined. The ejection determination includes measurement of the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated in FIG. 1, the paper output unit 26A for the target prints is provided with a sorter for collecting prints according to print orders.

Structure of the Head

Next, the structure of heads 12K, 12C, 12M and 12Y will be described. The heads 12K, 12C, 12M and 12Y of the respective ink colors have the same structure, and a reference numeral 50 is hereinafter designated to any of the heads.

Figure 3A:
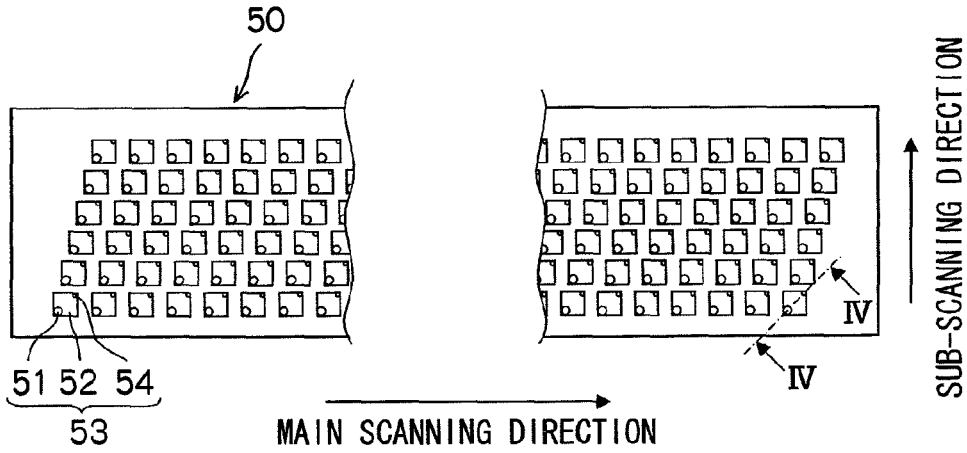
FIGS. 3A to 3C are plan view perspective diagrams showing examples of the composition of a printing head.
Figure 3B:
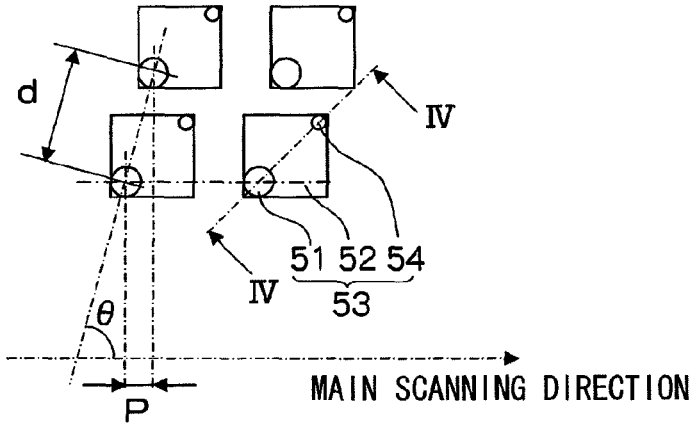
Figure 3C:
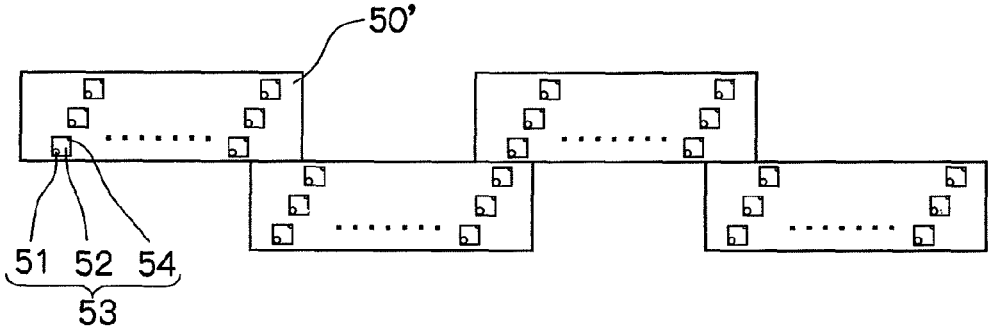
Figure 4:
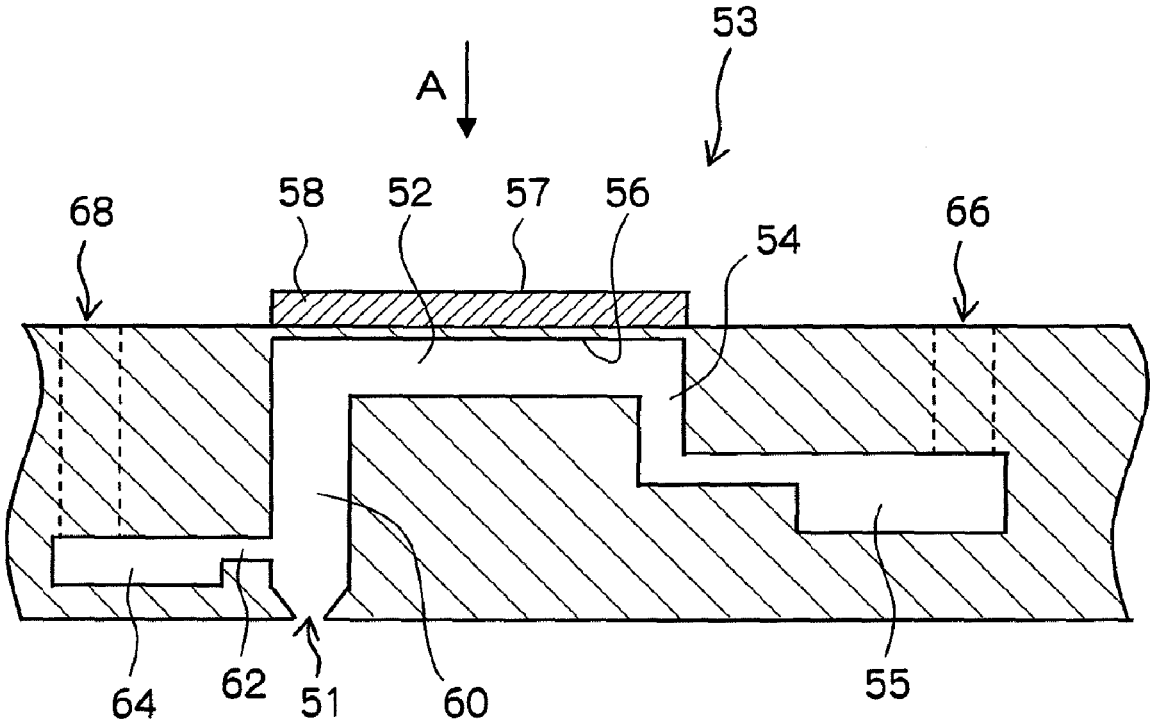
FIG. 4 is a cross-sectional diagram showing an ink chamber unit along line IV-IV in FIGS. 3A and 3B.
Figure 5:
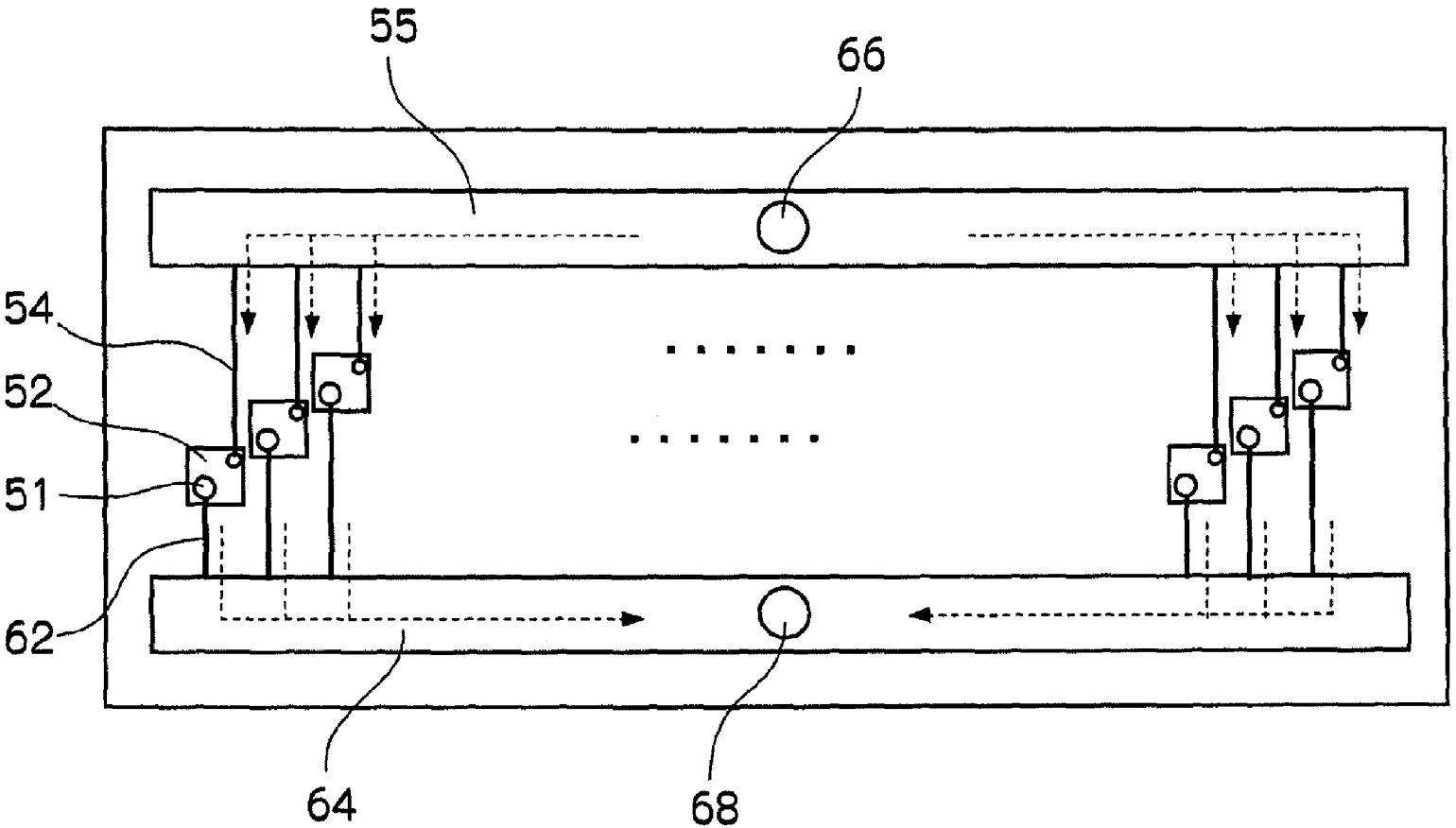
FIG. 5 is a flow channel schematic drawing showing the internal flow channel structure of a head 50.

FIG. 3A is a plan perspective diagram showing an example of the structure of a head 50, and FIG. 3B is a partial enlarged diagram of same. Moreover, FIG. 3C is a plan view perspective diagram showing a further example of the structure of the head 50. FIG. 4 is a cross-sectional diagram showing the composition of an ink chamber unit (a cross-sectional diagram along line IV-IV in FIGS. 3A and 3B). Furthermore, FIG. 5 is a flow channel composition diagram showing the structure of flow channels inside the head 50 (a plan view perspective diagram in direction A in FIG. 4).

The nozzle pitch in the head 50 should be minimized in order to maximize the density of the dots formed on the surface of the recording paper. As illustrated in FIGS. 3A and 3B, the head 50 according to the present embodiment has a structure in which a plurality of ink chamber units 53, each comprising a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the recording paper 16 in a direction substantially perpendicular to the paper conveyance direction is not limited to the example described above. For example, instead of the configuration in FIG. 3A, as illustrated in FIG. 3C, a line head having nozzle rows of a length corresponding to the entire width of the recording paper 16 can be formed by arranging and combining, in a staggered matrix, short head blocks (head chips) 50' having a plurality of nozzles 51 arrayed in a two-dimensional fashion. Furthermore, although not shown in the drawings, it is also possible to compose a line head by arranging short heads in one row.

The pressure chambers 52 provided corresponding to the respective nozzles 51 are approximately square-shaped in planar form, and a nozzle 51 and an ink inlet port 54 are provided respectively at either corner of a diagonal of each pressure chamber 52. Each pressure chamber 52 is connected via the ink inlet port 54 to a common flow channel 55. Furthermore, a nozzle flow channel 60 connected to each of the pressure chambers 52 is connected via an individual flow channel 62 to a common circulation flow channel 64. A supply port 66 and an outlet port 68 are provided in the head 50, the supply port 66 is connected to the common flow channel 55, and the outlet port 68 is connected to the common circulation flow channel 64.

In other words, the supply port 66 and the outlet port 68 of the head 50 are composed so as to be connected via an ink flow channel (which corresponds to the "internal flow channel" of embodiments of the present invention) which includes the common flow channel 55, the ink inlet ports 54, the pressure chambers 52, the nozzle flow channels 60, the individual flow channels 62, and the common circulation flow channel 64. Consequently, a portion of the ink which has been supplied to the supply port 66 from outside the head is ejected from the nozzles 51, and the remainder of the ink passes successively via the common flow channel 55, the nozzle flow channels 60, the individual flow channels 62 and the common circulation flow channel 64 (in other words, it is circulated via the internal ink flow channel of the head) and then output to the exterior of the head from the outlet port 68.

As illustrated in FIG. 4, a desirable composition is one in which the individual flow channels 62 are connected to the nozzle flow channels 60 in the vicinity of the nozzles 51, and therefore since the ink is allowed to circulate in the vicinity of the nozzles 51, increase in the viscosity of the ink inside the nozzle 51 is prevented and stable ejection can be achieved.

Piezoelectric elements 58 respectively provided with individual electrodes 57 are bonded to a diaphragm 56 which forms the upper face of the pressure chambers 52 and also serves as a common electrode, and each piezoelectric element 58 is deformed when a drive voltage is supplied to the corresponding individual electrode 57, thereby causing ink to be ejected from the corresponding nozzle 51. When ink is ejected, new ink is supplied to the pressure chambers 52 from the common flow channel 55, via the ink inlet ports 54.

In the present example, a piezoelectric element 58 is used as an ink ejection force generating device which causes ink to be ejected from a nozzle 50 provided in a head 51, but it is also possible to employ a thermal method in which a heater is provided inside the pressure chamber 52 and ink is ejected by using the pressure of the film boiling action caused by the heating action of this heater.

As illustrated in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the recording paper 16 is scanned in the breadthways direction (main scanning direction) of the recording paper 16, thereby performing printing in the breadthways direction, and when one printing action in the breadthways direction has been completed, the recording paper 16 is moved through a prescribed amount in the direction perpendicular to the breadthways direction (the sub-scanning direction), printing in the breadthways direction of the recording paper 16 is carried out in the next printing region, and by repeating this sequence, printing is performed over the whole surface of the printing region of the recording paper 16.

Configuration of Control System

Figure 6:
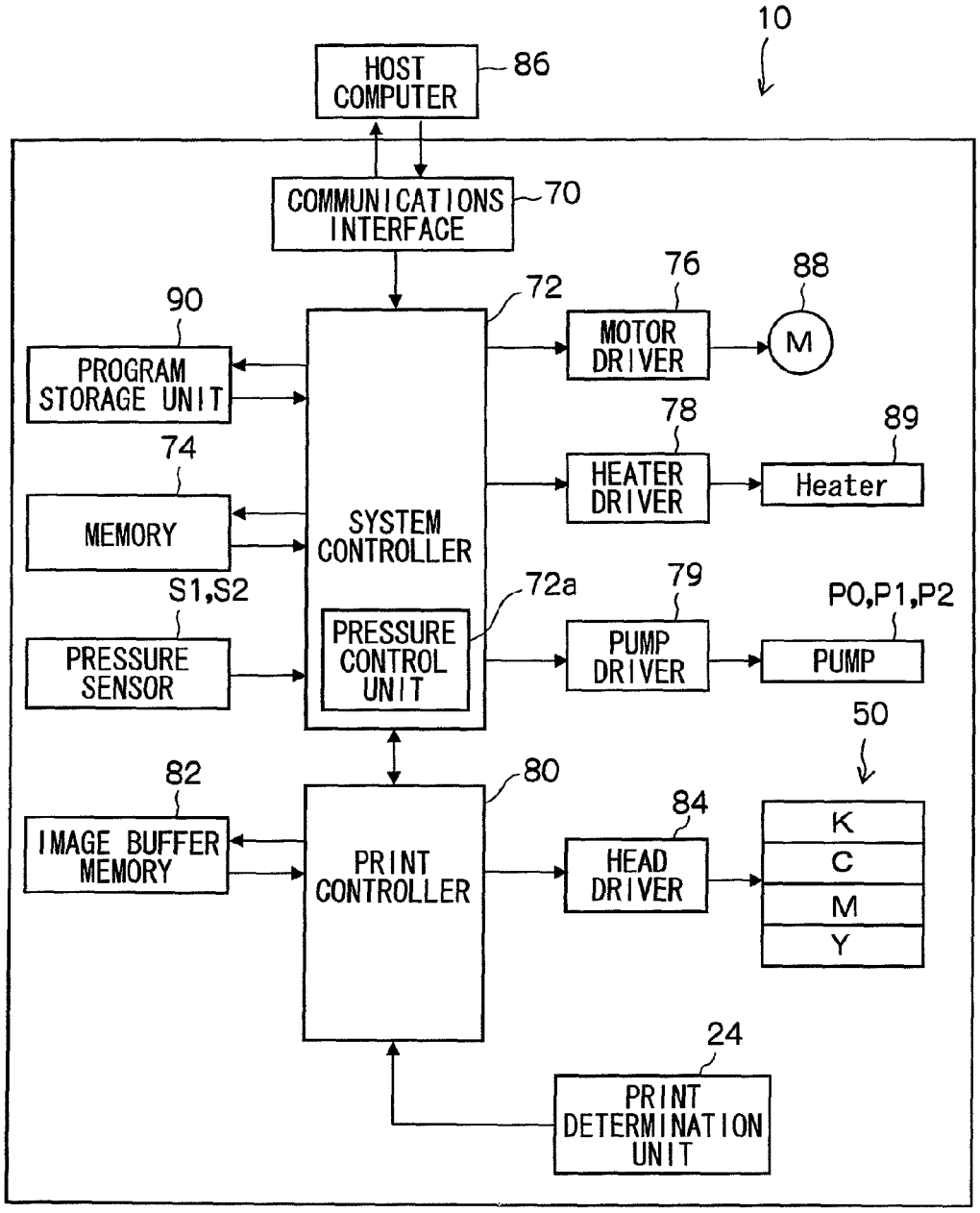
FIG. 6 is a principal block diagram showing a control system of the inkjet recording apparatus.

FIG. 6 is a principal block diagram showing the control system of the inkjet recording apparatus 10. The inkjet recording apparatus 10 comprises a communications interface 70, a system controller 72, a memory 74, a motor driver 76, a heater driver 78, a print controller 80, an image buffer memory 82, a head driver 84, and the like.

The communications interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communications interface 70. A buffer memory (not shown) may be mounted in this portion in order to increase the communication speed.

The image data sent from the host computer 86 is received by the inkjet recording apparatus 10 through the communications interface 70, and is temporarily stored in the memory 74. The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is a control unit which controls the respective sections, such as the communications interface 70, the memory 74, the motor driver 76, the heater driver 78, and the like. The system controller 72 is made up of a central processing unit (CPU) and peripheral circuits thereof, and as well as controlling communications with the host computer 86 and controlling reading from and writing to the memory 74, and the like, and it generates control signals for controlling the motors 88 of the conveyance system and the heaters 89.

Furthermore, the system controller 72 is a controller which controls the driving of pumps P0, P1, P2 of the ink supply system. In particular, as described hereinafter, the pressure control unit 72*a* of the system controller 72 controls the driving of the first sub pump P1 in accordance with the determination results of a pressure sensor S1 in such a manner that the interior of a liquid chamber 124 of a supply sub tank 120 assumes a prescribed pressure, and furthermore controls the driving of the second pump P2 in accordance with the determination results of a pressure sensor S2 in such a manner that the interior of a liquid chamber 134 of a recovery sub tank 130 assumes a prescribed pressure (see FIG. 7).

Programs executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver (drive circuit) 76 drives the motor 88 in accordance with commands from the system controller 72. The heater driver 78 drives the heater 89 of the post-drying unit 42 and the like in accordance with commands from the system controller 72.

Furthermore, the pump driver 79 is a driver which drives the pumps P0, P1, P2 of the ink supply system in accordance with instructions from the pressure control unit 72*a* of the system controller 72.

The print controller 80 has a signal processing function for performing various tasks, compensations, and other types of processing for generating print control signals from the image data stored in the memory 74 in accordance with commands from the system controller 72 so as to supply the generated print control signals (dot data) to the head driver 84. Necessary signal processing is carried out in the print controller 80, and the ejection amount and the ejection timing of the ink from the respective recording heads 50 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. The aspect illustrated in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 generates drive signals for driving the piezoelectric elements 58 (see FIG. 4) of the recording heads 50 of the respective colors, on the basis of dot data supplied from the print controller 80, and supplies the generated drive signals to the piezoelectric elements 58. A feedback control system for maintaining constant drive conditions in the recording heads 50 may be included in the head driver 84.

The print determination unit 24 is a block that includes the line sensor as described above with reference to FIG. 1, reads the image printed on the recording paper 16, determines the print conditions (presence of the ejection, variation in the dot formation, and the like) by performing prescribed signal processing, and the like, and provides the determination results of the print conditions to the print controller 80.

According to requirements, the print controller 80 makes various corrections with respect to the recording head 50 on the basis of information obtained from the print determination unit 24.

Various control programs are stored in the program storage unit 90, and the control programs are read out and executed in accordance with commands from the system controller 72. The program storage unit 90 may use a semiconductor memory, such as a ROM, EEPROM, or a magnetic disk, or the like. An external interface may be provided, and a memory card or PC card may also be used. Naturally, a plurality of these recording media may also be provided. The program storage unit 90 may also be combined with a storage device for storing operational parameters, and the like (not illustrated).

Composition of Ink Supply System

Next, an example of the composition of the ink supply system of the inkjet recording apparatus 10 which is a characteristic portion of embodiments (first to fourth embodiments) will be described.

First Embodiment

Figure 7:
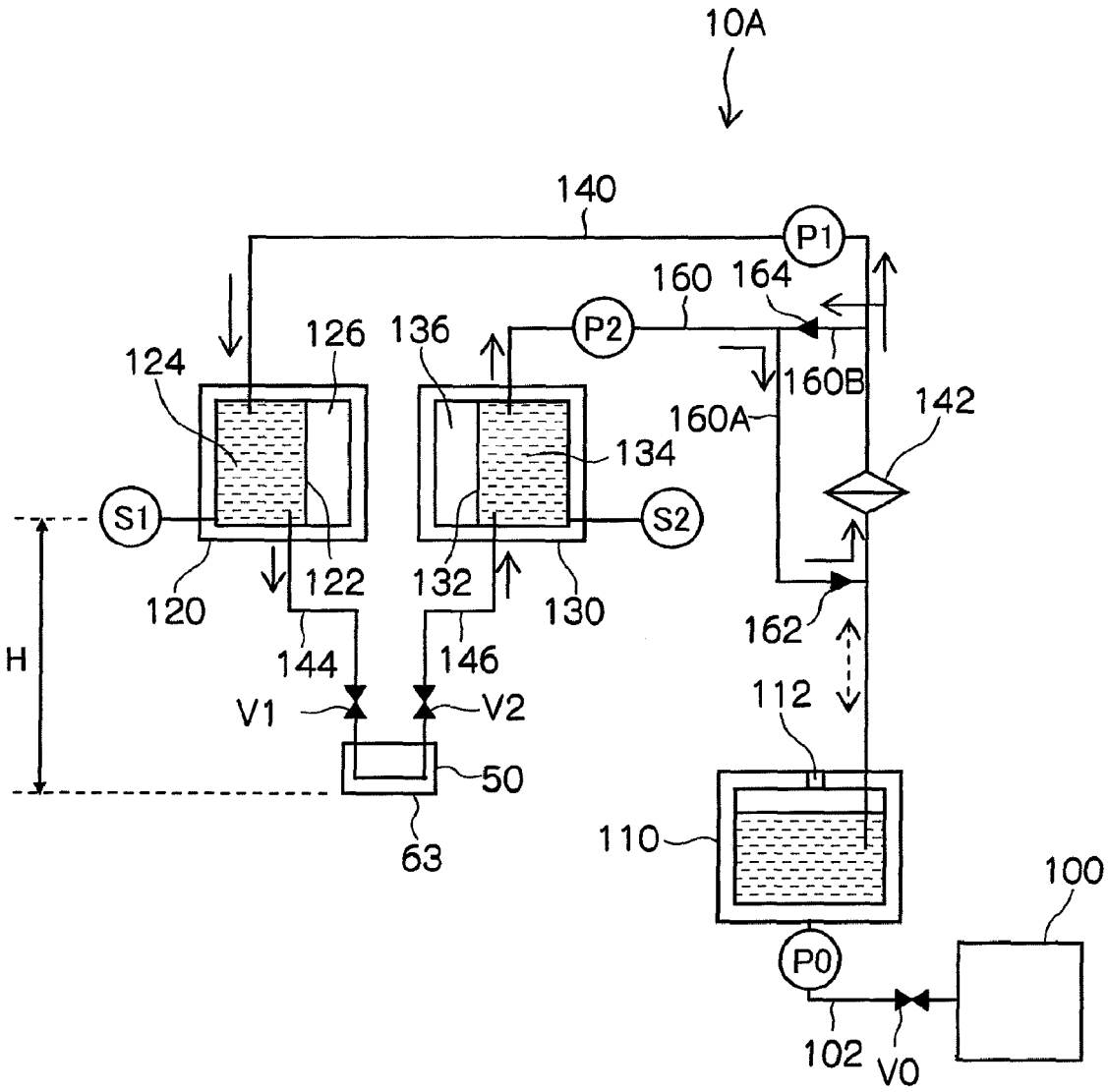
FIG. 7 is an approximate diagram showing an example of the composition of an ink supply system of an inkjet recording apparatus according to a first embodiment.

FIG. 7 is an approximate diagram showing an example of the composition of an ink supply system of an inkjet recording apparatus 10A according to a first embodiment. In FIG. 7, in order to simplify the description, the ink supply system relating to only one color is depicted, but in the case of a plurality of colors, a plurality of similar compositions are provided.

The inkjet recording apparatus 10A illustrated in FIG. 7 principally comprises: a buffer tank 110 which stores ink supplied from a main tank 100; a pair of sub tanks 120 and 130 (supply sub tank 120 and recovery sub tank 130) which are connected to the buffer tank 110; a head 50 which is connected to the sub tanks 120 and 130, pressure sensors S1 and S2 which determine the internal pressure of the sub tanks 120 and 130 respectively; and pumps P1 and P2 which adjust the interiors of the sub tanks 120 and 130 respectively to prescribed pressures by moving ink between the buffer tank 110 and the sub tanks 120 and 130.

The main tank 100 is a base tank (ink supply source) which stores ink to be supplied to the head 50, and corresponds to the tank which is disposed in the ink storage and loading unit 14 illustrated in FIG. 1. The main tank 100 and the buffer tank 110 are connected via the supply flow channel 102. A main tank opening and closing valve V0 which opens and closes the supply flow channel 102 and a main pump P0 are provided in this order from the upstream side (main tank 100 side) in the supply flow channel 102. By setting the main tank opening and closing valve V0 to an open state and driving the main pump P0, the ink inside the main tank 100 is supplied via the supply flow channel 102 to the buffer tank 110. Furthermore, when the main tank 100 is replaced, the main tank opening and closing valve V0 is set to a closed state, and hence leaking of ink from the supply flow channel 102 is prevented. A mode is also possible in which a check valve which only permits a flow of ink in the direction from the main tank 100 side to the buffer tank 110 side is provided instead of the main tank opening and closing valve V0.

The buffer tank 110 is a liquid storage unit (liquid buffer chamber) which stores ink supplied from the main tank 100. Furthermore, the buffer tank 110 is connected to the sub tanks 120 and 130 and as described below, ink is moved between the sub tanks 120 and 130 by means of the first and second sub pumps P1 and P2. An air connection port 112 is provided in the vertical upper portion of the buffer tank 110 and the interior of the buffer tank 110 is thereby connected to the outside air. By this means, when ink is moved between the sub tanks 120 and 130, it is possible to control the internal pressures of the sub tanks 120 and 130 independently without the ink which has flown out from the sub tanks 120 and 130 to the buffer tank 110 side reaching a dead-end situation.

The supply sub tank 120 has a composition in which the interior of a sealed container is partitioned into two spaces (a liquid chamber 124 and a gas chamber 126) by means of a flexible film 122, and the liquid chamber 124 and the gas chamber 126 both have sealed interiors. Furthermore, a pressure sensor S1 which determines the internal pressure of the liquid chamber 124 is provided in the supply sub tank 120.

Furthermore, one end of a first connecting flow channel 140 which connects to the buffer tank 110 is connected to the liquid chamber 124 of the supply sub tank 120, and a filter 142 and a first sub pump P1 are provided in the flow channel 140 in this order from the upstream side (the side of the buffer tank 110).

By changing the direction of rotation (drive direction) and the amount of rotation of the first sub pump P1, ink is moved between the buffer tank 110 and the liquid chamber 124 of the supply sub tank 120, and the interior of the liquid chamber 124 of the supply sub tank 120 can be adjusted to a prescribed pressure. For example, when the first sub pump P1 is driven in the forward direction, then ink flows into the liquid chamber 124 of the supply sub tank 120 from the buffer tank 110 side, and hence the internal pressure of the liquid chamber 124 of the supply sub tank 120 can be raised. On the other hand, when the first sub pump P1 is driven in the reverse direction, then the ink inside the liquid chamber 124 of the supply sub tank 120 flows out to the buffer tank 110 side, and hence the internal pressure of the liquid chamber 124 of the supply sub tank 120 can be lowered.

Preferably, the flexible film 122 which partitions the internal space of the supply sub tank 120 into two spaces (the liquid chamber 124 and the gas chamber 126) is constituted by an elastic film (made of rubber, for example). It is also possible to attenuate the sudden pressure changes caused by the first sub pump P1 or ink ejection from the head 50, by means of the elastic force of the flexible film (elastic film) 122 and an appropriate elastic force which is created by the compressive properties of the gas chamber 126. In the present example, air is filled into the gas chamber 126, but there are no particular restrictions on the gas which is filled into the gas chamber 126.

The recovery sub tank 130 uses the same composition as the supply sub tank 120. In other words, the recovery sub tank 130 has a composition in which the interior of a sealed container is partitioned into two spaces (a liquid chamber 134 and a gas chamber 136) by means of a flexible film 132, and the liquid chamber 134 and the gas chamber 136 both have sealed interior spaces. Moreover, a pressure sensor S2 which determines the internal pressure of the liquid chamber 134 is provided in the recovery sub tank 130. Preferably, the flexible film 132 is constituted by an elastic film (made of rubber, for example).

One end of a second connecting flow channel 160 is connected to the liquid chamber 134 of the recovery sub tank 130, and the other end thereof is branched into two flow channels (a first branch flow channel 160A and a second branch flow channel 160B). A second sub pump P2 is provided in the second connecting flow channel 160, on the side toward the recovery sub tank 130 with respect to the first and second branch flow channels 160A and 160B.

The first branch flow channel 160A is connected to the first connecting flow channel 140 between the filter 142 in the first connecting flow channel 140 and the buffer tank 110, and a check valve 162 which only permits a flow of ink in the direction from the recovery sub tank 130 (the second sub pump P2 side) toward the first connecting flow channel 140 is provided in the flow channel 160A. Furthermore, the second branch flow channel 160B is connected to the first connecting flow channel 140 between the filter 142 in the first connecting flow channel 140 and the first sub pump P1, and a check valve 164 which only permits flow of ink in the direction from the first connecting flow channel 140 toward recovery sub tank 130 (second sub pump P2) is provided in the flow channel 160B. A mode is also possible in which the first branch flow channel 160A is connected to the buffer tank 110 rather than the first connecting flow channel 140.

By changing the direction of rotation (drive direction) and the amount of rotation of the second sub pump P2, ink is moved between the buffer tank 110 (or the supply sub tank 120) and the recovery sub tank 130, and hence the interior of the liquid chamber 134 of the recovery sub tank 130 can be adjusted to a prescribed pressure.

For example, if the second sub pump P2 is driven in the forward direction, ink which has passed through the filter 142 from the buffer tank 110 (the first connecting flow channel 140) flows via the second branch flow channel 160B and into the liquid chamber 134 of the recovery sub tank 130, and hence the internal pressure of the liquid chamber 134 of the recovery sub tank 130 can be raised.

On the other hand, when the second sub pump P2 is driven in the reverse direction, the ink inside the liquid chamber 134 of the recovery sub tank 130 flows out to the buffer tank 110 (the second connecting flow channel 160) via the first branch flow channel 160A, and hence the internal pressure of the liquid chamber 134 of the recovery sub tank 130 can be lowered. The ink which has flowed into the first connecting flow channel 140 side from the liquid chamber 134 of the recovery sub tank 130 via the first branch flow channel 160A moves into the buffer tank 110 or either passes directly through the filter 142 and moves into the liquid chamber 124 of the supply sub tank 120, or alternatively moves into the liquid chamber 134 of the recovery sub tank 130 via the second branch flow channel 160B. In other words, the ink inside the buffer tank 110 or the ink which has been circulated to the recovery sub tank 130 from the supply sub tank 120 via the head 50 as described below is subjected to the removal of foreign matter, such as portions of increased viscosity, by the filter 142, and is then supplied to the sub tanks 120 and 130. Consequently, good ink which does not include foreign material is circulated to the head 50 and therefore the ejection stability is improved.

The sub tanks 120 and 130 are disposed in the vicinity of the head 50 vertically above same, and are connected to the head 50 via a first and a second circulation flow channels 144 and 146. More specifically, the liquid chamber 124 of the supply sub tank 120 and the supply port 66 of the head 50 are connected via the first circulation flow channel 144, and the liquid chamber 134 of the recovery sub tank 130 and the outlet port 68 of the head 50 are connected via the second circulation flow channel 146. The supply port 66 and the outlet port 68 of the head 50 are connected via the ink flow channel which is provided inside the head (the common flow channel 55, the pressure chambers 52, the common circulation flow channel 64, and the like). In other words, the liquid chamber 124 of the supply sub tank 120 and the liquid chamber 134 of the recovery sub tank 130 are composed so as to be connected via the ink flow channel of the head 50 (which corresponds to the "internal flow channel" according to embodiments of the present invention). In the respective circulation flow channels 144 and 146, opening and closing valves V1 and V2 which open and close the respective flow channels are provided.

The pressure control unit 72*a* of the system controller 72 (see FIG. 6) controls the driving of the first sub pump P1 on the basis of the determination result from the pressure sensor S1, in such a manner that the interior of the liquid chamber 124 of the supply sub tank 120 is adjusted to a prescribed pressure, and furthermore, controls the driving of the second sub pump P2 on the basis of determination results by the pressure sensor S2 in such a manner that the internal pressure of the liquid chamber 134 of the recovery sub tank 130 assumes a prescribed value.

Since the interior of the buffer tank 110 which is connected to the liquid chamber 124 of the supply sub tank 120 and the liquid chamber 134 of the recovery sub tank 130 is connected to the outside air, then it is possible to control the internal pressures of the liquid chamber 124 of the supply sub tank 120 and the liquid chamber 134 of the recovery sub tank 130 respectively and independently, without the ink that flows out from the liquid chamber 124 of the supply sub tank 120 or the liquid chamber 134 of the recovery sub tank 130 reaching a dead-end situation. In other words, it is possible to perform active sealed back pressure control which respectively and independently controls the internal pressures of the two sealed liquid chambers 124 and 134 by using a two-system pressure adjusting device.

Moreover, the pressure control unit 72*a* of the system controller 72 sets a prescribed pressure differential between the liquid chambers 124 and 134 in such a manner that the internal pressure of the liquid chamber 124 of the supply sub tank 120 is relatively higher than the internal pressure of the liquid chamber 134 of the recovery sub tank 130, and furthermore adjusts the internal pressures of the liquid chambers 124 and 134 by controlling the driving of the first sub pump P1 and the second sub pump P2 in such a manner that a prescribed back pressure (negative pressure) is applied to the ink inside the nozzles 51 of the head 50.

More specifically, taking the internal pressure of the liquid chamber 124 of the supply sub tank 120 to be $P_{in}$, taking the internal pressure of the liquid chamber 134 of the recovery sub tank 130 to be $P_{out}$, taking the back pressure (negative pressure) of the ink inside the nozzles 51 of the head 50 to be $P_{nzl}$, and taking the pressure differential caused by the height difference H between the nozzle surface 63 (ink ejection surface) of the head 50 and the liquid chambers 124 and 134 to be $\Delta P_h$, then control is implemented in such a manner that the following Expression (1) is satisfied:

$$P_{in}+\Delta P_h>P_{nzl}>P_{out}+\Delta P_h \quad (1).$$

Here, it is presumed that the liquid chambers 124 and 134 are positioned at the same height, but if these liquid chambers 124 and 134 are disposed at different heights, then Expression (1) should be rearranged in accordance with this height difference. In other words, taking the pressure differential caused by the height difference between the liquid chamber 124 of the supply sub tank 120 and the nozzle surface 63 of the head 50 to be $\Delta P_{h1}$, and taking the pressure differential caused by the height difference between the liquid chamber 134 of the recovery sub tank 130 and the nozzle surface 63 of the head 50 to be $\Delta P_{h2}$, then the following Expression (2) should be satisfied:

$$P_{in}+\Delta P_{h1}>P_{nzl}>P_{out}+\Delta P_{h2} \quad (2).$$

Furthermore, Expression (1) may be written in the following form, if the unit of pressure is set to "$mmH_2O$".

$$P_{in}+H>P_{nzl}>P_{out}+H \quad (3)$$

By this means, it is possible to circulate ink continuously at a prescribed speed from the liquid chamber 124 of the supply sub tank 120 toward the liquid chamber 134 of the recovery sub tank 130, passing via the head 50, while maintaining the back pressure (negative pressure) of the head 50.

The ink circulating operation of this kind is carried out constantly whenever the inkjet recording apparatus 10A is switched on. By implementing control in such a manner that the prescribed pressure differential is maintained between the liquid chamber 124 of the supply sub tank 120 and the liquid chamber 134 of the recovery sub tank 130, the ink is circulated constantly inside the head 50 (and in particular, in the vicinity of the nozzles) regardless of the ejection status of the head 50, and therefore ejection errors caused by increase in the viscosity of the ink, or the like, are prevented and satisfactory printing quality can be maintained over a long period of time.

Figure 8:
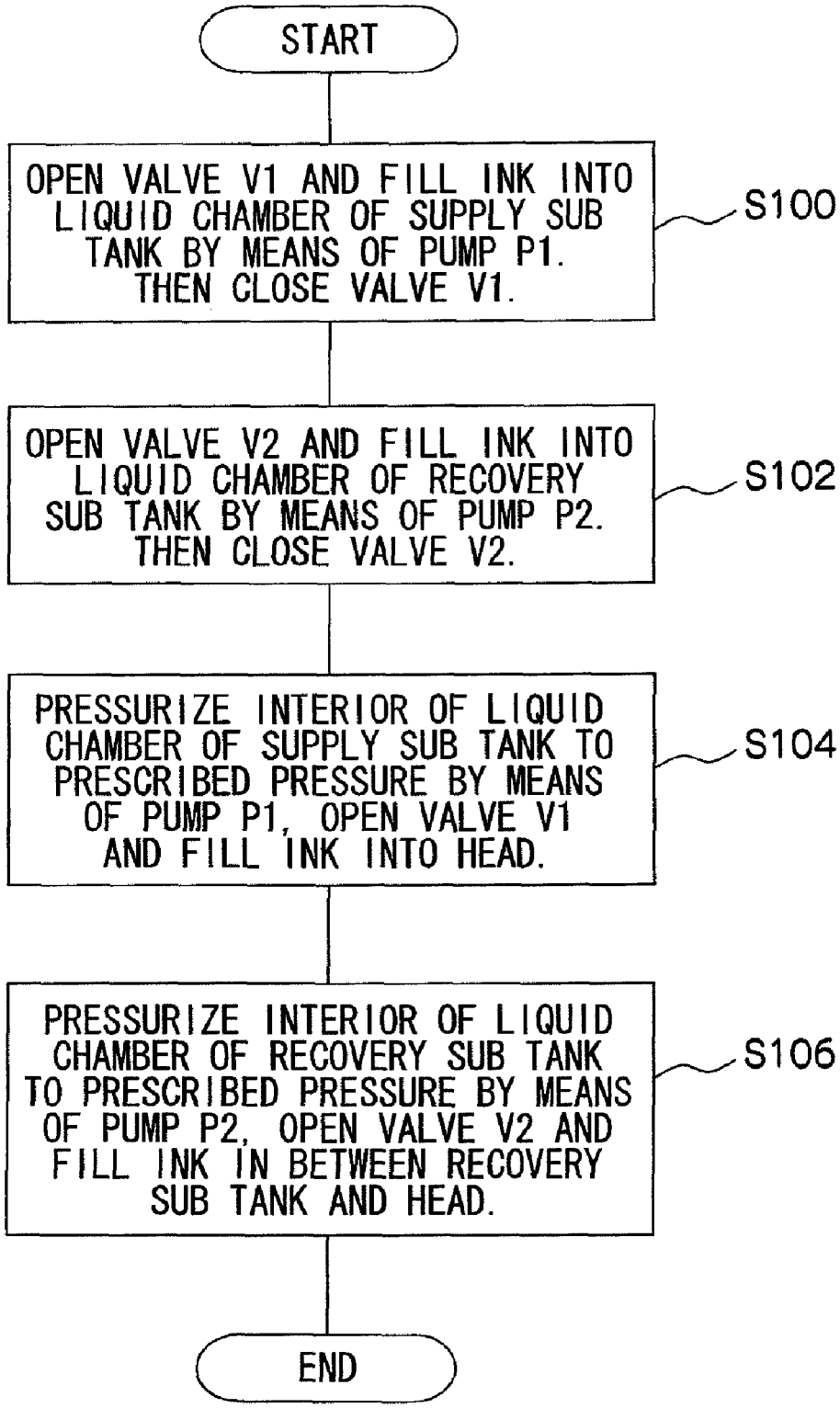
FIG. 8 is a flowchart showing one example of an ink loading operation according to the first embodiment.

FIG. 8 is a flowchart showing one example of an ink loading operation according to the first embodiment. Here, in order to simplify the description, it is supposed that a prescribed amount of ink has already been supplied from the main tank 100 to the buffer tank 110 due to driving of the main pump P0. Furthermore, it is supposed that the opening and closing valves V0 to V2 are closed at the stage when the ink loading operation (ink filling operation) is started up.

In FIG. 8, firstly, at step S100, the opening and closing valve V1 of the first circulation flow channel 144 is opened, the first sub pump P1 is driven in the forward direction, and ink is supplied from the buffer tank 110 to the liquid chamber 124 of the supply sub tank 120. When ink has been filled into the liquid chamber 124 of the supply sub tank 120, the opening and closing valve V1 of the first circulation flow channel 144 is set to a closed state.

Next, in step S102, the opening and closing valve V2 of the second circulation flow channel 146 is opened, the second sub pump P2 is driven in the forward direction, and ink is supplied from the buffer tank 110 via the second branch flow channel 160B to the liquid chamber 134 of the recovery sub tank 130. When ink has been filled into the liquid chamber 134 of the recovery sub tank 130, the opening and closing valve V2 of the second circulation flow channel 146 is set to a closed state.

Next, at step S104, the first sub pump P1 is driven in the forward direction, and pressure is applied in such a manner that the interior of liquid chamber 124 of the supply sub tank 120 assumes a prescribed pressure. Thereupon, the opening and closing valve V1 of the first circulation flow channel 144 is opened and ink is filled into the head 50 and the first circulation flow channel 144.

Next, at step S106, the second sub pump P2 is driven in the forward direction, and pressure is applied in such a manner that the interior of liquid chamber 134 of the recovery sub tank 130 assumes a prescribed pressure. Thereupon, the opening and closing valve V2 of the second circulation flow channel 146 is opened and ink is filled into the second circulation flow channel 146 between the liquid chamber 134 of the recovery sub tank 130 and the head 50. In this way, the ink loading operation (ink filling operation) is completed.

In the present embodiment, as illustrated in FIG. 7, a composition is explained above in which one head 50 is provided with respect to a pair of sub tanks 120, 130, but the implementation of the present invention is not limited to this and it is also possible to provide a plurality of heads 50.

Figure 9:
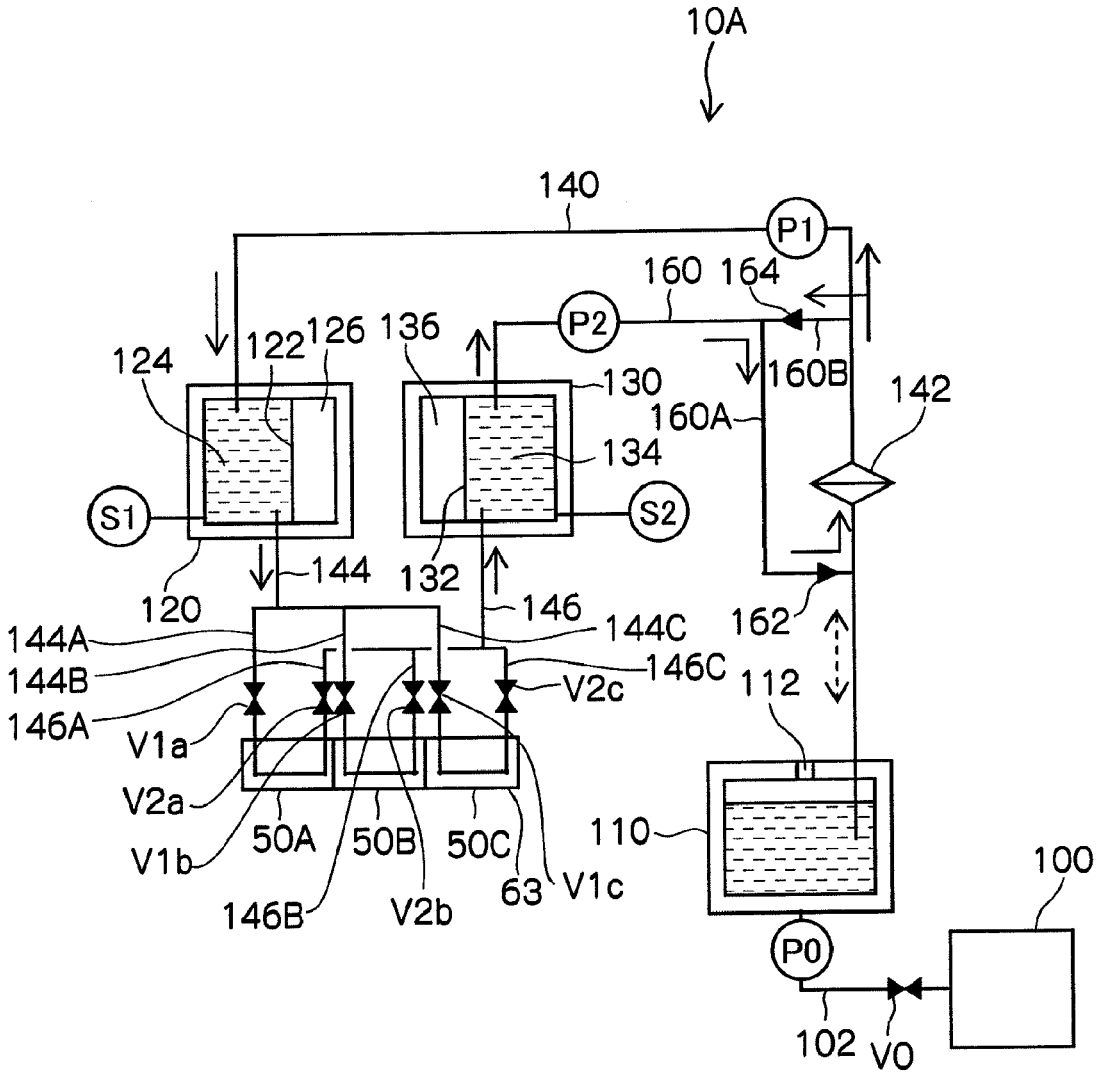
FIG. 9 is an approximate diagram showing a farther example of the composition of the ink supply system of the inkjet recording apparatus according to the first embodiment.

FIG. 9 is a schematic drawing showing one example of a mode where a plurality of heads 50 (50A to 50C) are provided with respect to one pair of sub tanks 120 and 130. As illustrated in FIG. 9, the first circulation flow channel 144 which is connected to the liquid chamber 124 of the supply sub tank 120 is branched into a plurality of channels (in the present embodiment, three channels) in accordance with the number of heads, and the resulting branch flow channels 144A to 144C are connected to the supply ports 66 of the respective heads 50A to 50C, and opening and closing valves V1*a* to V1*c* are provided respectively in the flow channels 144A to 144C. In a similar manner, the second circulation flow channel 146 which is connected to the liquid chamber 134 of the recovery sub tank 130 is branched into a plurality of channels (in the present embodiment, three channels) in accordance with the number of heads, and the resulting branch flow channels 144A to 144C are connected to the outlet ports 68 of the respective heads 50A to 50C, and opening and closing valves V2*a* to V2*c* are provided respectively in the flow channels 146A to 146C.

According to a mode where a plurality of heads 50 are provided with respect to one pair of sub tanks 120 and 130, it is possible to achieve uniform back pressure and ink circulation speed in the plurality of heads 50, and hence the ejected liquid droplets can be made uniform between the plurality of heads 50.

According to the present embodiment, one pair of sub tanks 120 and 130 and a buffer tank 110 are provided, and by moving ink between the buffer tank 110 and the liquid chambers 124 and 134 of the sub tanks 120 and 130, the internal pressures of the liquid chambers 124 and 134 of the sub tanks 120 and 130 can be maintained respectively at prescribed pressures, and furthermore, since a prescribed pressure differential is set between the liquid chambers 124 and 134 of the sub tanks 120 and 130 and control is implemented in such a manner that a prescribed back pressure is applied to the ink inside the nozzles 51 of the head 50, then it is possible to circulate ink continuously in one direction, while maintaining the back pressure (negative pressure) of the head 50. By this means, it is possible to improve the ejection reliability of the head 50 and to obtain stable and satisfactory print quality.

Moreover, since the internal pressures of the liquid chamber 124 and the liquid chamber 134 of the sub tanks 120 and 130 can be control respectively, then the freedom of arrangement of the sub tanks 120 and 130 with respect to the head 50 is raised and it is possible to make the apparatus compact in size. Preferably, the sub tanks 120 and 130 are positioned in the vicinity of the head 50 vertically above same, as in the present embodiment, and since the circulation flow channels 144 and 146 which connect the sub tanks 120 and 130 with the head 50 are composed with a short length, then it is possible to reduce the pressure variation caused by pressure loss in the flow channels 144 and 146, the accuracy of the pressure differential applied between the supply port 66 and the outlet port 68 of the head 50 is improved, and it is possible to achieve a circulation of ink at low speed in the vicinity of the nozzles. Of course, a mode is also possible in which the sub tanks 120 and 130 are disposed vertically below the head 50.

Furthermore, when ink flows into or out from the liquid chamber 124 of the supply sub tank 120 due to the driving of the first sub pump P1, the flexible film (desirably, an elastic film) 122 and the gas chamber 126 of the supply sub tank 120 function as a damper which attenuates the pressure variation caused by the first sub pump P1, and therefore it is possible to prevent the pressure variation being transmitted to the head 50 and good print quality can therefore be maintained. Moreover, it is also possible to control ink circulation at a very slow flow speed. The same also applies to the recovery sub tank 130, whereby it is possible to attenuate the pressure variation caused by the second sub pump P2, by means of the flexible film (preferably, elastic film) 132 and the gas chamber 136.

The implementation of the present invention is not limited to a composition in which the interior of each of the scaled containers which constitute the sub tanks 120 and 130 is partitioned into two spaces (a liquid chamber and a gas chamber) by means of a flexible film, and it is also possible to compose each of the sub tanks 120 and 130 by means of a liquid chamber (sealed container) only. In this case also, preferably, a flexible film (elastic film) is provided between a portion of the liquid chamber and the exterior. However, since there is no elastic force created by the compressive properties of the gas chamber, then a greater effect is obtained in attenuating the sudden pressure variations due to the movement of ink caused by the first sub pump P1, the second sub pump P2 and ejection of liquid droplets by the head 50, and the like, but on the other hand, the responsiveness of pressure adjustment achieved by the first sub pump P1 and the second sub pump P2 declines. Accordingly, it is desirable to set the elastic force of the flexible film to an appropriate force by altering the elastic force of the flexible film or by providing a spring member which impels the flexible film, or another such method.

Second Embodiment

Next, a second embodiment of the present invention will be described. Below, portions which are common with those of the first embodiment are not explained further, and the following description centers on characteristic features of the present embodiment.

Figure 10:
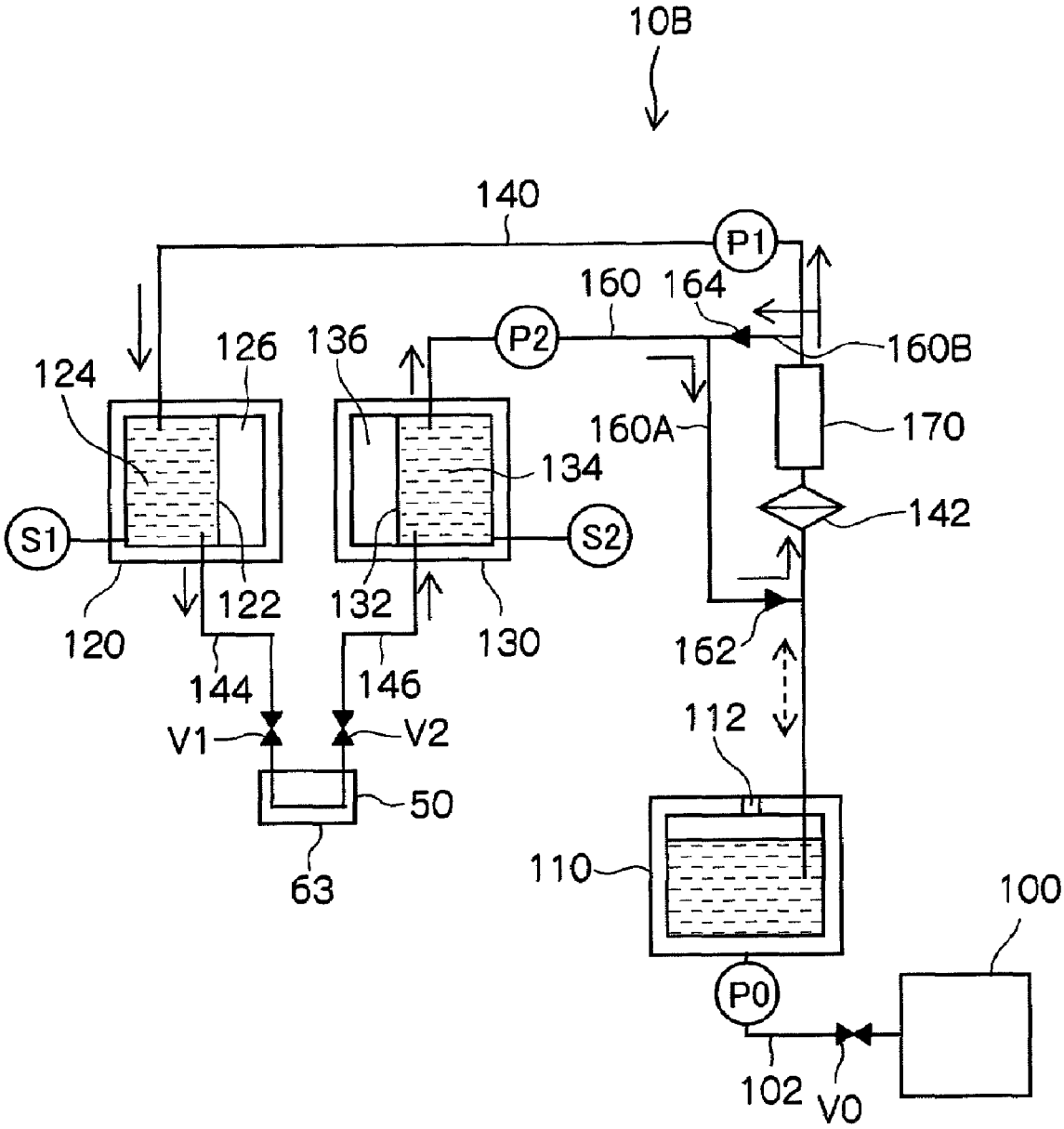
FIG. 10 is an approximate diagram showing an example of the composition of an ink supply system of an inkjet recording apparatus according to a second embodiment.

FIG. 10 is an approximate diagram illustrating an example of the composition of an ink supply system of an inkjet recording apparatus 10B according to the second embodiment. In FIG. 10, parts which are common with those in FIG. 7 are labeled with the same reference numerals.

As illustrated in FIG. 10, in the inkjet recording apparatus 10B according to the present embodiment, a deaerator 170 is provided in the first connecting flow channel 140. More specifically, a deaerator 170 is provided on the downstream side of the filter 142 (the side adjacent to the supply sub tank 120) in the first connecting flow channel 140, and to the upstream side of the junction with the second branch flow channel 160B (namely, the side adjacent to the buffer tank 10). Accordingly, the ink inside the buffer tank 110 and the ink which has been circulated from the supply sub tank 120 via the head 50 to the recovery sub tank 130 passes through the filter 142 and the deaerator 170 and then arrives at the sub tanks 120 and 130.

The deaerator 170 removes dissolved gas which has dissolved in the ink passing through same, and also removes gas bubbles which remain without having dissolved into the ink. A commonly known deaeration apparatus may be used for the deaerator 170, and therefore the detailed composition is not described here.

In implementing the present embodiment, there are no particular restrictions on the arrangement sequence of the filter 142 and the deaerator 170, but as illustrated in FIG. 10, it is desirable that the filter 142 and the deaerator 170 should be provided in this order from the upstream side (the buffer tank side 110) of the first connecting flow channel 140. Foreign matter such as ink of increased viscosity is included in the ink inside the buffer tank 110 and the ink that has been circulated to the recovery sub tank 130 from the supply sub tank 120 and via the head 50, and therefore by introducing the ink into the deaerator 170 after it has passed through the filter 142, it is possible to prevent increase in pressure loss due to blockages of the deaerator 170, and hence a long life span can be achieved in the deaerator 170.

Moreover, the ink which is circulated from the supply sub tank 120 to the recovery sub tank 130 via the head 50 includes gas bubbles and the like and has a reduced level of deaeration, but by passing this ink through the deaerator 170 together with the ink inside the buffer tank 110 before supplying the ink to the sub tanks 120 and 130, ink having a good level of deaeration is circulated through the head 50 and therefore good ejection characteristics can be maintained.

Furthermore, the deaerator 170 is disposed outside of the path which generates a pressure differential in order to create a circulation of ink (namely, outside the path from the first sub pump P1 via the supply sub tank 120, the head 50 and the recovery sub tank 130 to the pump P2), and therefore it is possible to control the internal pressures of the sub tanks 120 and 130 to a high degree of accuracy, without being affected by the pressure loss arising in the deaerator 170.

Third Embodiment

Next, a third embodiment of the present invention will be described. Below, portions which are common with those of the first and the second embodiments are not explained further, and the following description centers on characteristic features of the present embodiment.

Figure 11:
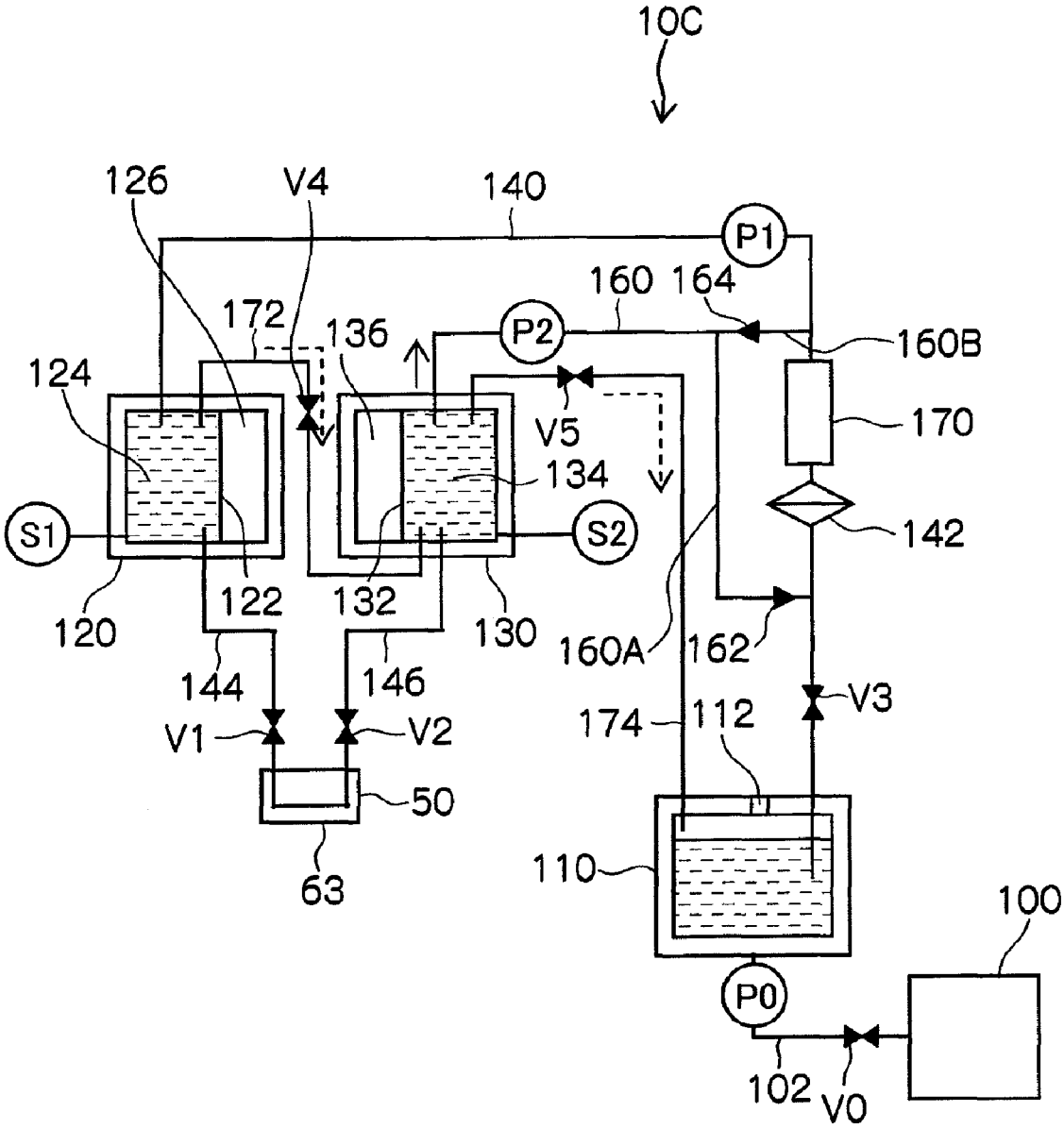
FIG. 11 is an approximate diagram showing an example of the composition of an ink supply system of an inkjet recording apparatus according to a third embodiment.

FIG. 11 is an approximate diagram showing an example of the composition of an ink supply system of an inkjet recording apparatus 10C according to a third embodiment. In FIG. 11, parts which are common with those in FIGS. 7 and 10 are labeled with the same reference numeral.

As illustrated in FIG. 11, a first expulsion flow channel 172 which connects the upper surface (vertical upper portion) of the liquid chamber 124 of the supply sub tank 120 with the liquid chamber 134 of the recovery sub tank 130 and a second expulsion flow channel 174 which connects the upper surface (vertical upper portion) of the liquid chamber 134 of the recovery sub tank 130 with the buffer tank 110 are provided in the inkjet recording apparatus 10C according to the present embodiment. Furthermore, in the first and second expulsion flow channels 172 and 174, opening and closing valves V4 and V5 which open and close the respective flow channels are provided. Moreover, an opening and closing valve V3 which opens and closes the first connecting flow channel 140 is provided in the first connecting flow channel 140 to the upstream side (buffer tank 110 side) of the junction with the first branch flow channel 160A.

Figure 12:
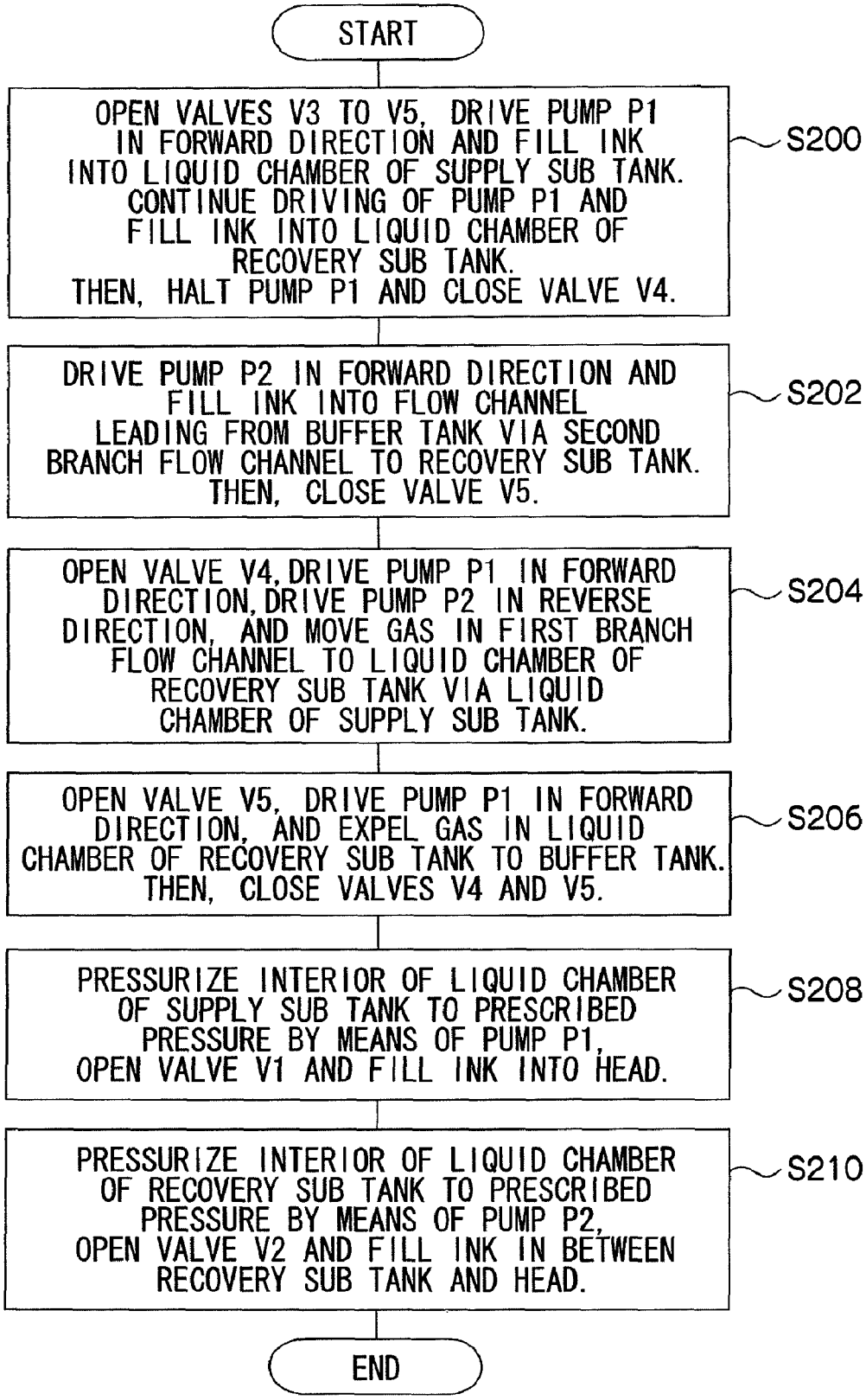
FIG. 12 is a flowchart showing one example of an ink loading operation according to the third embodiment.

FIG. 12 is a flowchart showing one example of an ink loading operation according to the third embodiment. Here, similarly to the case of FIG. 8, in order to simplify the description, it is supposed that a prescribed amount of ink has already been supplied from the main tank 100 to the buffer tank 110 due to driving of the main pump P0. Furthermore, it is supposed that the opening and closing valves V0 to V5 are closed at the stage when the ink loading operation is started up.

In FIG. 12, firstly, at step S200, the opening and closing valve V3 of the first connecting flow channel 140, the opening and closing valve V4 of the first expulsion flow channel 172 and the opening and closing valve V5 of the second expulsion flow channel 174 are opened, the first sub pump P1 is driven in the forward direction, and ink is filled into the liquid chamber 124 of the supply sub tank 120 from the buffer tank 110. By this means, the gas which is initially present inside the liquid chamber 124 of the supply sub tank 120 moves to the liquid chamber 134 of the recovery sub tank 130 via the first expulsion flow channel 172. Subsequently, the first sub pump P1 is driven in the forward direction, and ink is filled into the liquid chamber 134 of the recovery sub tank 130 from the liquid chamber 124 of the supply sub tank 120, via the first expulsion flow channel 172. By this means, the gas present inside the liquid chamber 134 of the recovery sub tank 130 (including the gas that is present initially) is moved to the buffer tank 110 via the second expulsion flow channel 174. Thereupon, the driving of the first sub pump P1 is halted and the opening and closing valve V4 is closed.

Next, at step S202, with the opening and closing valve V3 and the opening and closing valve V5 in an opened state, the second sub pump P2 is driven in the forward direction and ink is filled into the flow channel from the buffer tank 110 via the first branch flow channel 160A to the liquid chamber 134 of the recovery sub tank 130. Thereupon, the opening and closing valve V5 is closed.

Next, at step S204, the opening and closing valve V4 is opened, and with the opening and closing valves V3 and V4 in an opened state, the first sub pump P1 is driven in the forward direction, the second sub pump P2 is driven in the reverse direction, and the gas inside the first branch flow channel 160A is moved from the first connecting flow channel 140 to the liquid chamber 134 of the recovery sub tank 130 via the liquid chamber 124 of the supply sub tank 120 and the first expulsion flow channel 172.

Thereupon, at step S206, the opening and closing valve V5 is opened, and with the opening and closing valves V3 to V5 in an opened state, the first sub pump P1 is driven in the forward direction and the gas inside the liquid chamber 134 of the recovery sub tank 130 is moved to the buffer tank 110. Thereupon, the opening and closing valves V4 and V5 are closed.

Next, at step S208, with the opening and closing valve V3 in an opened state, the first sub pump P1 is driven in the forward direction and pressure is applied in such a manner that the interior of the liquid chamber 124 of the supply sub tank 120 assumes a prescribed pressure. Thereupon, the opening and closing valve V1 is then opened and ink is filled into the head 50 and the first circulation flow channel 144.

Next, at step S210, with the opening and closing valve V3 in an open state, the second sub pump P2 is driven in the forward direction, and pressure is applied in such a manner that the interior of liquid chamber 134 of the recovery sub tank 130 assumes a prescribed pressure. Thereupon, the opening and closing valve V2 is opened and ink is filled into the second circulation flow channel 146 between the liquid chamber 134 of the recovery sub tank 130 and the head 50. In this way, the ink loading operation (ink filling operation) is completed.

According to the present embodiment, upon initial filling of ink, the gas inside the ink circulation channel is expelled together with the ink to the buffer tank 110, via the first expulsion flow channel 172 and the second expulsion flow channel 174, and can then be expelled into the outside air via the air connection port 112 of the buffer tank 110. Consequently, even when carrying out initial filling of ink in a state where the liquid chambers 124 and 126 of the sub tanks 120 and 130 are sealed, there is no need to expel all of the large amount of gas which is present inside the ink circulation channel from the nozzles 51 of the head 50, and hence the gas expulsion properties can be improved. Furthermore, the ink which is expelled to the buffer tank 110 together with the gas via the first expulsion flow channel 172 and the second expulsion flow channel 174 passes through the filter 142 and the deaerator 170 and is circulated to the sub tanks 120 and 130, and therefore it is also possible to make effective use of this ink.

Even if there is a large amount of gas present in the liquid chambers 124 and 134 of the sub tanks 120 and 130 and the upstream side of same (the buffer tank 110 side), it is possible to move the gas to the buffer tank 110 by using the first and second expulsion flow channels 172 and 174 and to expel this gas to the exterior of the apparatus, without passing via the head 50 and the circulation flow channels 144 and 146. Therefore, with no gas bubbles being adhered to the interiors of the head 50 and the circulation flow channels 144 and 146, it is possible to prevent decline in the ejection reliability caused by adherence of gas bubbles and decline in the pressure control characteristics.

In the present embodiment, an example is described above which is related to a method of expelling the gas inside the liquid chambers 124 and 134 of the sub tanks 120 and 130 from the buffer tank 110 to the exterior of the apparatus, by using the first and second expulsion flow channels 172 and 174, upon the initial filling of ink; however, this is not limited to the ink filling operation, and the gas can also be expelled to the exterior of the apparatus by means of the first and second expulsion flow channels 172 and 174, for example, upon starting up the apparatus, during printing, during maintenance, or other situations.

Fourth Embodiment

Next, a fourth embodiment of the present invention will be described. Below, portions which are common with those of the first to third embodiments are not explained further, and the following description centers on characteristic features of the present embodiment.

Figure 13:
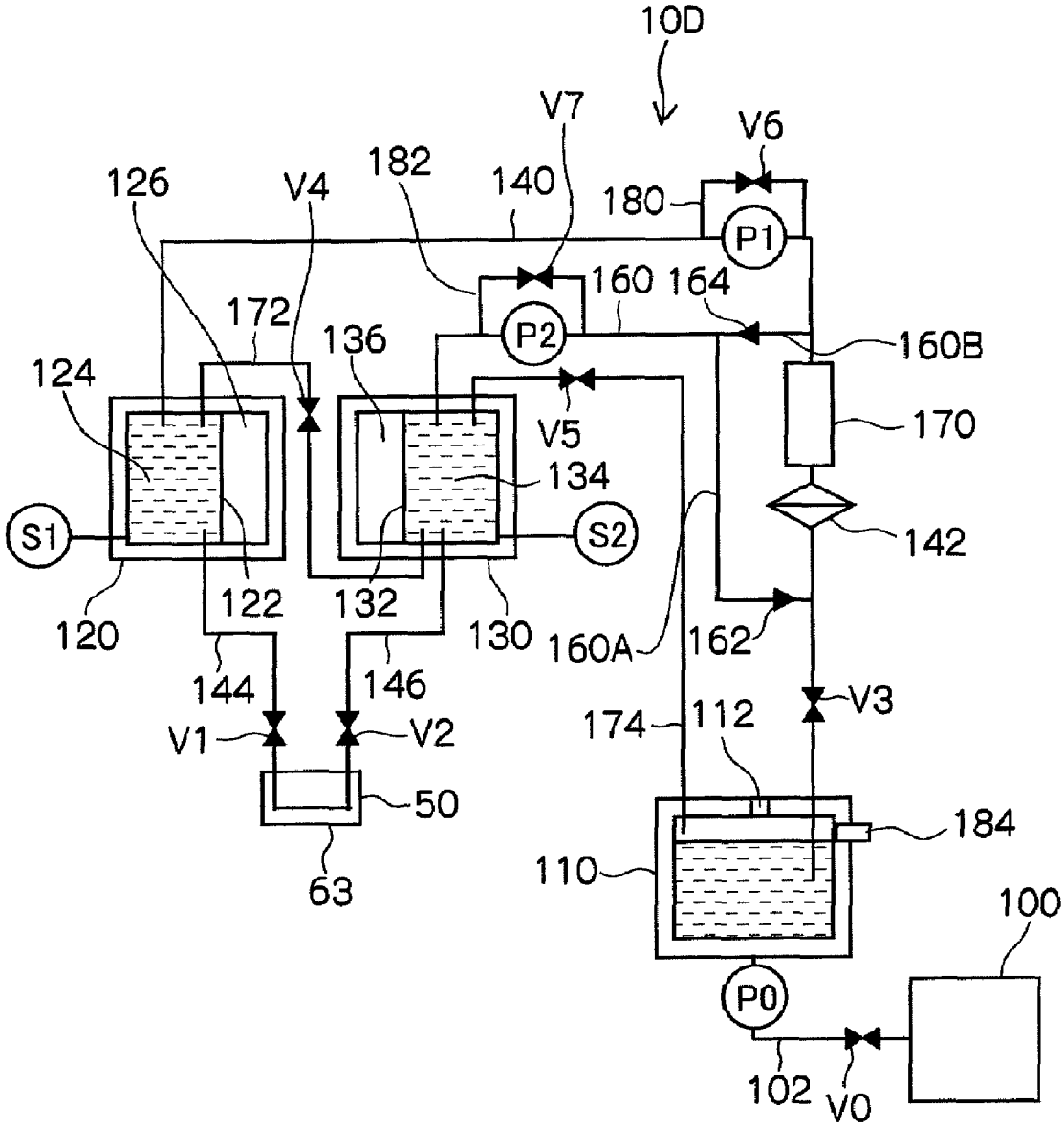
FIG. 13 is an approximate diagram showing an example of the composition of an ink supply system of an inkjet recording apparatus according to a fourth embodiment.

FIG. 13 is an approximate diagram showing an example of the composition of an ink supply system of an inkjet recording apparatus 10D according to the fourth embodiment. In FIG. 13, parts which are common with those in FIGS. 7, 10 and 11 are labeled with the same reference numeral.

As illustrated in FIG. 13, in the inkjet recording apparatus 10D according to the present embodiment, the first and second sub pumps P1 and P2 are constituted by pumps which do not leak at any time, and a first bypass flow channel 180 which connects the ports for ink-input/output on both sides of the first sub pump P1 with each other and a second bypass flow channel 182 which connects the ports for ink-input/output on both sides of the second sub pump P2 with each other are provided.

In the respective bypass flow channels 180 and 182, opening and closing valves V6 and V7 which open and close the respective flow channels are provided, and these opening and closing valves V6 and V7 are constituted by opening and closing valves which are normally open and leave the flow channel open when the power supply is switched off. Furthermore, the opening and closing valves V1, V2 and V3 which are disposed, as illustrated in FIG. 13, in the flow channel from the buffer tank 110 to the head 50 (the first connecting flow channel 140, the second connecting flow channel 160, the first circulation flow channel 144 and the second circulation flow channel 146) are also constituted by opening and closing valves which are normally open.

Furthermore, a liquid surface sensor 184 which determines the height of the liquid surface of the ink stored in the buffer tank 110 is provided in buffer tank 110. The system controller 72 controls the driving of the main pump P0 in accordance with the determination results of the liquid surface sensor 184 in such a manner that the surface of the ink inside the buffer tank 110 lies vertically below the nozzle surface 63 of the head 50 (the ink ejection surface), and ink is moved between the main tank 100 and the buffer tank 110 so as to adjust the level of the ink inside the buffer tank 110. It is also possible to provide a movement mechanism which alters the relative height of the buffer tank 110 and the head 50 instead of adjusting the surface level of the ink.

By means of this composition, when the power supply of the inkjet recording apparatus 10D is switched off, the flow channels from the buffer tank 110 to the head 50 (first connecting flow channel 140, second connecting flow channel 160, first circulation flow channel 144 and second circulation flow channel 146) are connected together and communicate with each other. Furthermore, when the power supply is switched off, a prescribed negative pressure is applied to the ink inside the nozzles 51 of the head 50 due to the liquid head differential caused by the height difference between the level of the ink surface inside the buffer tank 110 and the nozzle surface 63 of the head 50, and hence the meniscus is maintained in position.

In this way, even if the inkjet recording apparatus 10D is left with the power switched off, the meniscus is maintained due to the liquid head differential, and therefore infiltration of gas bubbles and ink-leaking from the nozzles 51 of the head 50 occurring due to the expansion or contraction of the ink as a result of change in the ambient temperature or the like, are prevented, the frequency of maintenance of the head 50 upon restart of operation is reduced, and hence running costs can be lowered and the start-up time of the apparatus can be shortened. Furthermore, since the opening and closing valves used are of a normally open type, then the head 50 and the buffer tank 110 are naturally connected with each other and communicate with each other when the power is switched off, and this provides a countermeasure in response to emergencies, such as sudden interruptions of the power supply.

Above, inkjet recording apparatuses and recording methods according to embodiments of the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a recording head of an inkjet type having a liquid ejection surface where a plurality of nozzles which eject liquid are arranged, a supply port which supplies the liquid to an internal flow channel connected to the plurality of nozzles, and an outlet port which is connected to the supply port via the internal flow channel and through which the liquid in the internal flow channel is expelled;

a first liquid chamber which is connected to the supply port of the recording head via a first external flow channel;

a second liquid chamber which is connected to the outlet port of the recording head via a second external flow channel;

a liquid buffer chamber which stores the liquid supplied from a liquid supply source;

a first connecting flow channel which connects the first liquid chamber to the liquid buffer chamber;

a second connecting flow channel which connects the second liquid chamber to the liquid buffer chamber;

a first pressure determination device which determines an internal pressure of the first liquid chamber;

a second pressure determination device which determines an internal pressure of the second liquid chamber;

a liquid movement device which moves the liquid between the first liquid chamber, the second liquid chamber and the liquid buffer chamber;

a pressure control device which controls the liquid movement device in accordance with determination results of the first pressure determination device and the second pressure determination device in such a manner that interiors of the first liquid chamber and the second liquid chamber respectively assume prescribed pressures, and a filter provided in the first connecting flow channel, wherein the pressure control device controls the liquid movement device so as to adjust the internal pressures of the first liquid chamber and the second liquid chamber in such a manner that a prescribed pressure differential between the internal pressures of the first liquid chamber and the second liquid chamber is produced and a prescribed back pressure is applied to the liquid inside the plurality of nozzles of the recording head;

one end of the second connecting flow channel is connected to the second liquid chamber and another end of the second connecting flow channel is branched into a first branch flow channel and a second branch flow channel;

the first branch flow channel is connected to the first connecting flow channel on a side closer to the liquid buffer chamber than the filter;

the second branch flow channel is connected to the first connecting flow channel on a side closer to the first liquid chamber than the filter;

a first check valve which permits a flow of the liquid only in a direction from the second liquid chamber toward the first connecting flow channel is provided in the first branch flow channel; and a second check valve which permits a flow of the liquid only in a direction from the first connecting flow channel toward the second liquid chamber is provided in the second branch flow channel.

2. The inkjet recording apparatus as defined in claim 1, comprising a first sub tank having the first liquid chamber and a first gas chamber that are separated by a first flexible film, and a second sub tank having the second liquid chamber and a second gas chamber that are separated by a second flexible film.

3. The inkjet recording apparatus as defined in claim 1, wherein the first liquid chamber and the second liquid chamber are disposed vertically above the recording head.

4. The inkjet recording apparatus as defined in claim 1, further comprising a deaerator provided in the first connecting flow channel at a position between a part of the first connecting flow channel to which the first branch flow channel is connected and a part of the first connecting flow channel to which the second branch flow channel is connected.

5. The inkjet recording apparatus as defined in claim 4, wherein the deaerator is disposed on a side closer to the first liquid chamber than the filter.

6. The inkjet recording apparatus as defined in claim 1, wherein the liquid movement device includes: a first pump which is provided in the first connecting flow channel; and a second pump which is provided in the second connecting flow channel.

7. The inkjet recording apparatus as defined in claim 6, further comprising:

a first bypass flow channel which connects a liquid input port and a liquid output port of the first pump;

a second bypass flow channel which connects a liquid input port and a liquid output port of the second pump;

a first bypass flow channel opening and closing valve which opens and closes the first bypass flow channel; and a second bypass flow channel opening and closing valve which opens and closes the second bypass flow channel, wherein:

the first pump and the second pump are constituted respectively by pumps which are constantly free of leaks;

the first bypass flow channel opening and closing valve is constituted by a normally open valve which opens the first bypass flow channel when power supply is switched off, and the second bypass flow channel opening and closing valve is constituted by a normally open valve which opens the second bypass flow channel when power supply is switched off; and the liquid buffer chamber is disposed in such a manner that a surface of the liquid stored in the liquid buffer chamber is disposed vertically below the liquid ejection surface of the recording head.

8. The inkjet recording apparatus as defined in claim 1, further comprising:

a first expulsion flow channel via which a vertical upper portion of the first liquid chamber is connected to the second liquid chamber; and a second expulsion flow channel via which a vertical upper portion of the second liquid chamber is connected to the liquid buffer chamber.

9. A recording method of an inkjet recording apparatus comprising: a recording head of an inkjet type having a plurality of nozzles which eject liquid, a supply port which supplies the liquid to an internal flow channel connected to the plurality of nozzles, and an outlet port which is connected to the supply port via the internal flow channel and through which the liquid in the internal flow channel is expelled; a first liquid chamber which is connected to the supply port of the recording head via a first external flow channel; a second liquid chamber which is connected to the outlet port of the recording head via a second external flow channel; a liquid buffer chamber which stores the liquid supplied from a liquid supply source; a first connecting flow channel which connects the first liquid chamber to the liquid buffer chamber; a second connecting flow channel which connects the second liquid chamber to the liquid buffer chamber; a first pressure determination device which determines an internal pressure of the first liquid chamber; a second pressure determination device which determines an internal pressure of the second liquid chamber; a liquid movement device which moves the liquid between the first liquid chamber, the second liquid chamber and the liquid buffer chamber; and a filter provided in the first connecting flow channel, wherein the liquid movement device is controlled according to determination results of the first pressure determination device and the second pressure determination device in such a manner that interiors of the first liquid chamber and the second liquid chamber respectively assume prescribed pressures, and the liquid movement device is controlled so as to adjust the internal pressures of the first liquid chamber and the second liquid chamber in such a manner that a prescribed pressure differential is set between the internal pressures of the first liquid chamber and the second liquid chamber and a prescribed back pressure is applied to the liquid inside the plurality of nozzles of the recording head;

one end of the second connecting flow channel is connected to the second liquid chamber and another end of the second connecting flow channel is branched into a first branch flow channel and a second branch flow channel;

the first branch flow channel is connected to the first connecting flow channel on a side closer to the liquid buffer chamber than the filter;

the second branch flow channel is connected to the first connecting flow channel on a side closer to the first liquid chamber than the filter;

a first check valve which permits a flow of the liquid only in a direction from the second liquid chamber toward the first connecting flow channel is provided in the first branch flow channel; and a second check valve which permits a flow of the liquid only in a direction from the first connecting flow channel toward the second liquid chamber is provided in the second branch flow channel.

* * * * *